US010997891B1

(12) United States Patent
Zhang et al.

(10) Patent No.: US 10,997,891 B1
(45) Date of Patent: May 4, 2021

(54) DISPLAY PANEL AND DISPLAY APPARATUS WITH DEMULTIPLEXER, AND DRIVING METHOD THEREOF

(71) Applicant: Shanghai Tianma AM-OLED Co.,Ltd., Shanghai (CN)

(72) Inventors: Mengmeng Zhang, Shanghai (CN); Xingyao Zhou, Shanghai (CN); Yue Li, Shanghai (CN); Shuai Yang, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 16/730,475

(22) Filed: Dec. 30, 2019

(30) Foreign Application Priority Data

Oct. 31, 2019 (CN) ..... 201911051592.9

(51) Int. Cl.
*G09G 3/20* (2006.01)
*G09G 3/30* (2006.01)

(52) U.S. Cl.
CPC ..... *G09G 3/20* (2013.01); *G09G 3/30* (2013.01); *G09G 2300/0408* (2013.01); *G09G 2300/0426* (2013.01); *G09G 2310/0286* (2013.01); *G09G 2310/0297* (2013.01); *G09G 2310/08* (2013.01)

(58) Field of Classification Search
CPC ..... G09G 3/30–3/3291; G09G 2300/0426; G09G 2310/00–2310/08; G09G 3/20
See application file for complete search history.

(56) References Cited

U.S. PATENT DOCUMENTS

| | | | | |
|---|---|---|---|---|
| 10,103,214 | B2 * | 10/2018 | Kim | G09G 3/3291 |
| 2007/0124633 | A1 * | 5/2007 | Kim | G09G 3/3266 714/726 |
| 2017/0140706 | A1 * | 5/2017 | Song | G09G 3/3233 |
| 2018/0061366 | A1 * | 3/2018 | Aflatooni | G09G 3/32 |
| 2018/0218684 | A1 * | 8/2018 | Choi | G09G 3/3233 |
| 2019/0206966 | A1 * | 7/2019 | Kim | H01L 27/3276 |
| 2020/0111420 | A1 * | 4/2020 | Yang | G09G 3/3233 |

FOREIGN PATENT DOCUMENTS

| | | | |
|---|---|---|---|
| CN | 110148384 | A | 8/2019 |
| KR | 20180115205 | A | 10/2018 |

* cited by examiner

*Primary Examiner* — Gene W Lee
(74) *Attorney, Agent, or Firm* — Anova Law Group PLLC

(57) ABSTRACT

A display panel, a method for driving a display panel and a display apparatus are provided. The display panel includes a plurality of pixels, a plurality of gate lines and a plurality of data lines; a multiplexer including a plurality of selectors; a plurality of control lines electrically connected to the plurality of selectors, and a plurality of shift register groups. Each of the plurality of control lines is used to control an output terminal of the selector to output a data signal to the data line. Each shift register group includes a plurality of cascaded shift registers and each shift register is electrically connected to at most two of the plurality of gate lines. There are N rows of pixels between pixels corresponding to two of the plurality of gate lines electrically connected to a same shift register and N is a positive integer.

20 Claims, 12 Drawing Sheets

DISPLAY PANEL AND DISPLAY APPARATUS WITH DEMULTIPLEXER, AND DRIVING METHOD THEREOF

CROSS-REFERENCES TO RELATED APPLICATIONS

This application claims priority of Chinese Patent Application No. 201911051952.9, filed on Oct. 31, 2019, the entire contents of which are hereby incorporated by reference.

FIELD OF THE DISCLOSURE

The present disclosure generally relates to the field of display technology and, more particularly, relates to a display panel and a method for driving a display panel, and a display apparatus.

BACKGROUND

The electroluminescent display is a self-luminous device, which can realize the display function without a backlight module. Thus, the electroluminescent display may be made to be light and thin, and has a wide range of applications in various fields.

Electroluminescent displays generally have two specifications: conventional products and high-frequency products. The conventional products can be referred to as products with a scanning frequency of 60 Hz, and the high-frequency products can be referred to as products with a scanning frequency of 120 Hz. Currently, the conventional product is usually provided with a multiplexer, and the charging time of the corresponding gate scan signal is generally less than 0.5 microseconds. When the configuration of the conventional product is used for a high frequency product, the charging time of the gate scan signal is also less than 0.5 microseconds. Under such a condition, the charging time of the gate scan signal is seriously insufficient, and a vertical streak problem is prone to occur when the screen is displayed, and the display effect is reduced.

Thus, there is a need to improve the display performance of the high-frequency electroluminescence displays. The disclosed display panel and method for driving the display panel, and display apparatus are directed to solve one or more problems set forth above and other problems in the art.

BRIEF SUMMARY OF THE DISCLOSURE

One aspect of the present disclosure provides a display panel. The display panel may include a display area; a non-display area surrounding the display area; and a plurality of pixels in the display area. Each pixel includes a pixel circuit; the pixel circuit includes a first writing terminal configured to control a writing of an initialization signal and a second writing terminal configured to control a writing of a data signal. The display panel may also include a plurality of gate lines and a plurality of data lines. The gate lines include a first gate line electrically connected to the first writing terminal of the pixel circuit and a second gate line electrically connected to the second writing terminal of the pixel circuit; each column of pixel circuits correspond to Q data lines; and Q is an integer greater than one. Any two adjacent pixel circuits of each column of pixel circuits are correspondingly connected to different data lines; and each column of pixel circuits are electrically connected to different date lines. The display panel may also include a multiplexer in the non-display area. The multiplexer includes a plurality of selectors, and an output terminal of each selector is electrically connected to a corresponding data line. Further, the display panel may include a plurality of control lines electrically connected to the plurality of selectors. A number of the control lines is equal to a number of output terminals of the plurality of selectors and each of the plurality of control lines is used to control an output terminal of the selector to output a data signal to the data line. Further, the display panel may include a plurality of shift register groups in the non-display area. Each shift register group includes a plurality of cascaded shift registers; and each shift register is electrically connected to at most two of the plurality of gate lines; there are N rows of pixels between pixels corresponding to two of the plurality of gate lines electrically connected to a same shift register; and N is a positive integer.

Another aspect of the present disclosure provides a method for driving a display panel. The method may include providing a display panel. The display panel may include a display area; a non-display area surrounding the display area; and a plurality of pixels in the display area. Each pixel includes a pixel circuit; the pixel circuit includes a first writing terminal configured to control a writing of an initialization signal and a second writing terminal configured to control a writing of a data signal. The display panel may also include a plurality of gate lines and a plurality of data lines. The gate lines include a first gate line electrically connected to the first writing terminal of the pixel circuit and a second gate line electrically connected to the second writing terminal of the pixel circuit; each column of pixel circuits correspond to Q data lines; and Q is an integer greater than one. Any two adjacent pixel circuits of each column of pixel circuits are correspondingly connected to different data lines; and each column of pixel circuits are electrically connected to different date lines. The display panel may also include a multiplexer in the non-display area. The multiplexer includes a plurality of selectors, and an output terminal of each selector is electrically connected to a corresponding data line. Further, the display panel may include a plurality of control lines electrically connected to the plurality of selectors. A number of the control lines is equal to a number of output terminals of the plurality of selectors and each of the plurality of control lines is used to control an output terminal of the selector to output a data signal to the data line. Further, the display panel may include a plurality of shift register groups in the non-display area. Each shift register group includes a plurality of cascaded shift registers; and each shift register is electrically connected to at most two of the plurality of gate lines; there are N rows of pixels between pixels corresponding to two of the plurality of gate lines electrically connected to a same shift register; and N is a positive integer.

Another aspect of the present disclosure provides a display apparatus. The display apparatus may include a display panel. The display panel may include a display area; a non-display area surrounding the display area; and a plurality of pixels in the display area. Each pixel includes a pixel circuit; the pixel circuit includes a first writing terminal configured to control a writing of an initialization signal and a second writing terminal configured to control a writing of a data signal. The display panel may also include a plurality of gate lines and a plurality of data lines. The gate lines include a first gate line electrically connected to the first writing terminal of the pixel circuit and a second gate line electrically connected to the second writing terminal of the pixel circuit; each column of pixel circuits correspond to Q data lines; and Q is an integer greater than one. Any two adjacent pixel circuits of each column of pixel circuits are correspondingly connected to different data lines; and each column of pixel circuits are electrically connected to different date lines. The display panel may also include a multiplexer in the non-display area. The multiplexer includes a plurality of selectors, and an output terminal of each selector is electrically connected to a corresponding data line. Further, the display panel may include a plurality of control lines electrically connected to the plurality of selectors. A number of the control lines is equal to a number of output terminals of the plurality of selectors and each of the plurality of control lines is used to control an output terminal of the selector to output a data signal to the data line. Further, the display panel may include a plurality of shift register groups in the non-display area. Each shift register group includes a plurality of cascaded shift registers; and each shift register is electrically connected to at most two of the plurality of gate lines; there are N rows of pixels between pixels corresponding to two of the plurality of gate lines electrically connected to a same shift register; and N is a positive integer.

Other aspects of the present disclosure can be understood by those skilled in the art in light of the description, the claims, and the drawings of the present disclosure.

BRIEF DESCRIPTION OF THE DRAWINGS

The following drawings are incorporated in and constitute a part of the specification, illustrating embodiments of the present disclosure, and together with the detailed descriptions serve to explain the mechanism of the present disclosure.

DETAILED DESCRIPTION

Figure 1:
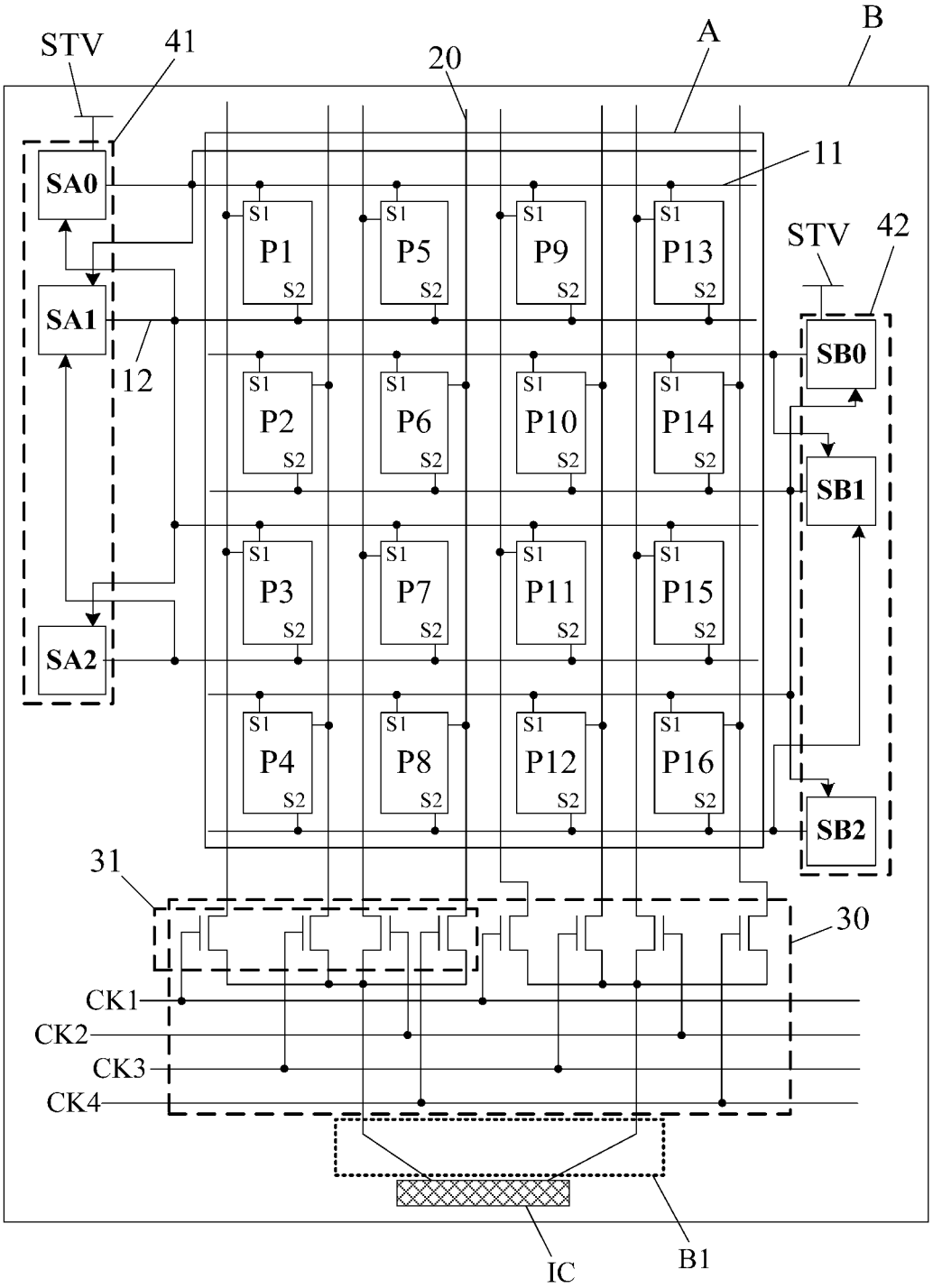
FIG. 1 illustrates an exemplary display panel consistent with various disclosed embodiments of the present disclosure.

Reference will now be made in detail to exemplary embodiments of the disclosure, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all the embodiments of the present disclosure. Based on the disclosed embodiments, persons of ordinary skill in the art may derive other embodiments consistent with the present disclosure, all of which are within the scope of the present disclosure. Further, in the present disclosure, the disclosed embodiments and the features of the disclosed embodiments may be combined when there are no conflicts.

For a display that is not provided with a multiplexer (i.e., demux), such as a display designed with hipin, the time for a conventional product (such as a product with a scanning frequency of 60 Hz) to display a frame is generally 16.67 ms. If the resolution of such a product is 1080×2340, the time to scan one row of pixels is 16.67 ms/2340. In particular, the time to scan one row of pixels is 7.1 μs. However, in the actual scanning process, factors, such as the time interval of gate scan signals input by adjacent gate lines, need to be considered. Thus, the time for scanning a row of pixels is generally less than 5 μs.

Similarly, for the high-frequency products designed with hipin (such as products with a scanning frequency of 120 Hz), because the scanning frequency is increased, if the time corresponding to display one frame remains the same, the time to scan a row of pixels needs to at least be reduced to one-half of that of the low-frequency product. Thus, the charging time of the gate scan signal of the high-frequency product is insufficient, and a vertical streak phenomenon is prone to appear in the display screen. Accordingly, the display effect to is decreased.

For high-frequency products equipped with a multiplexer (e.g., mux), if a gate scan signal is input to a gate line, the gate scan signal is input to the gate line after the control line corresponding to the pixel row corresponding to the gate line finishes outputting the control signal. Under such a condition, during the time of scanning one row of pixels, the charging time of the gate scan signal is reduced to less than 0.5 μs, which causes the charging time of the gate scan signal to be seriously insufficient.

For a large-size and high-resolution display (such as 4K or 8K displays), as the number of scanning lines is further increased, the time to scan one row of pixels may be further decreased. Accordingly, during scanning one row of pixels, the charging time of the gate scan signal may be even shorter. Thus, the display performance may be significantly reduced.

The present disclosure provides a display panel with an improved display effect of high-frequency products and a method for driving the display panel, and a display apparatus.

Figure 2:
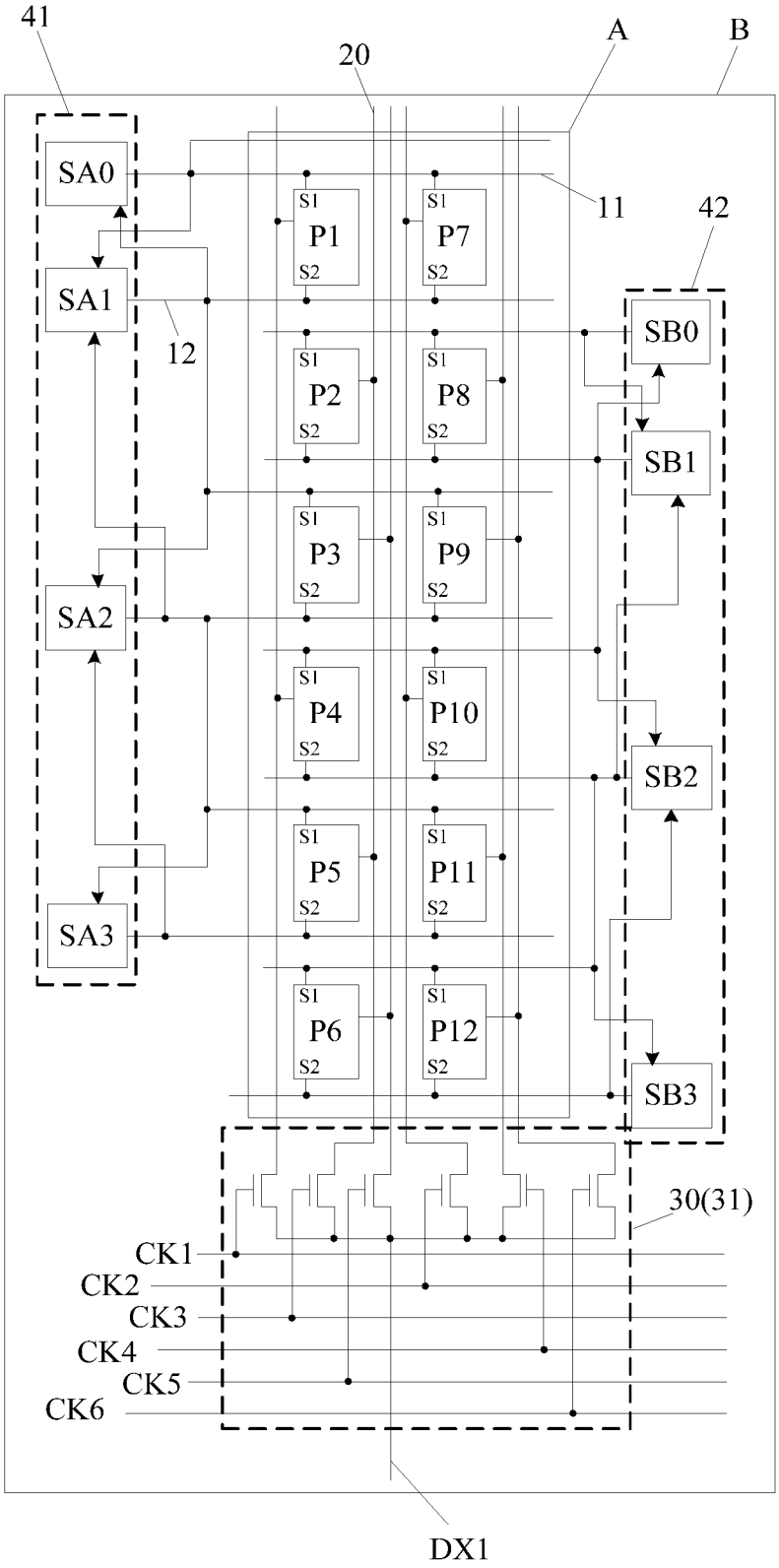
FIG. 2 illustrates another exemplary display panel consistent with various disclosed embodiments of the present disclosure.
Figure 3:
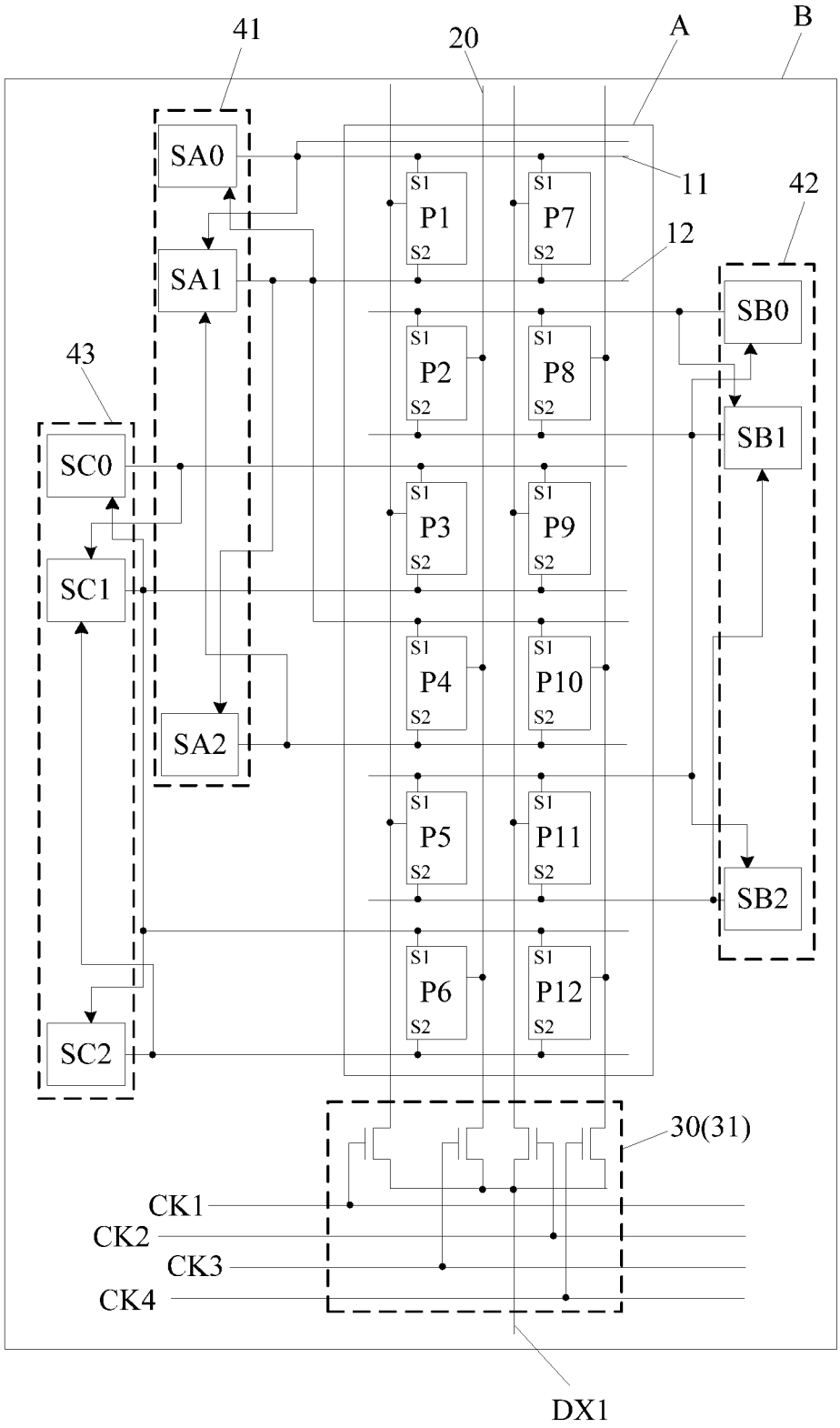
FIG. 3 illustrates another exemplary display panel consistent with various disclosed embodiments of the present disclosure.
Figure 4:
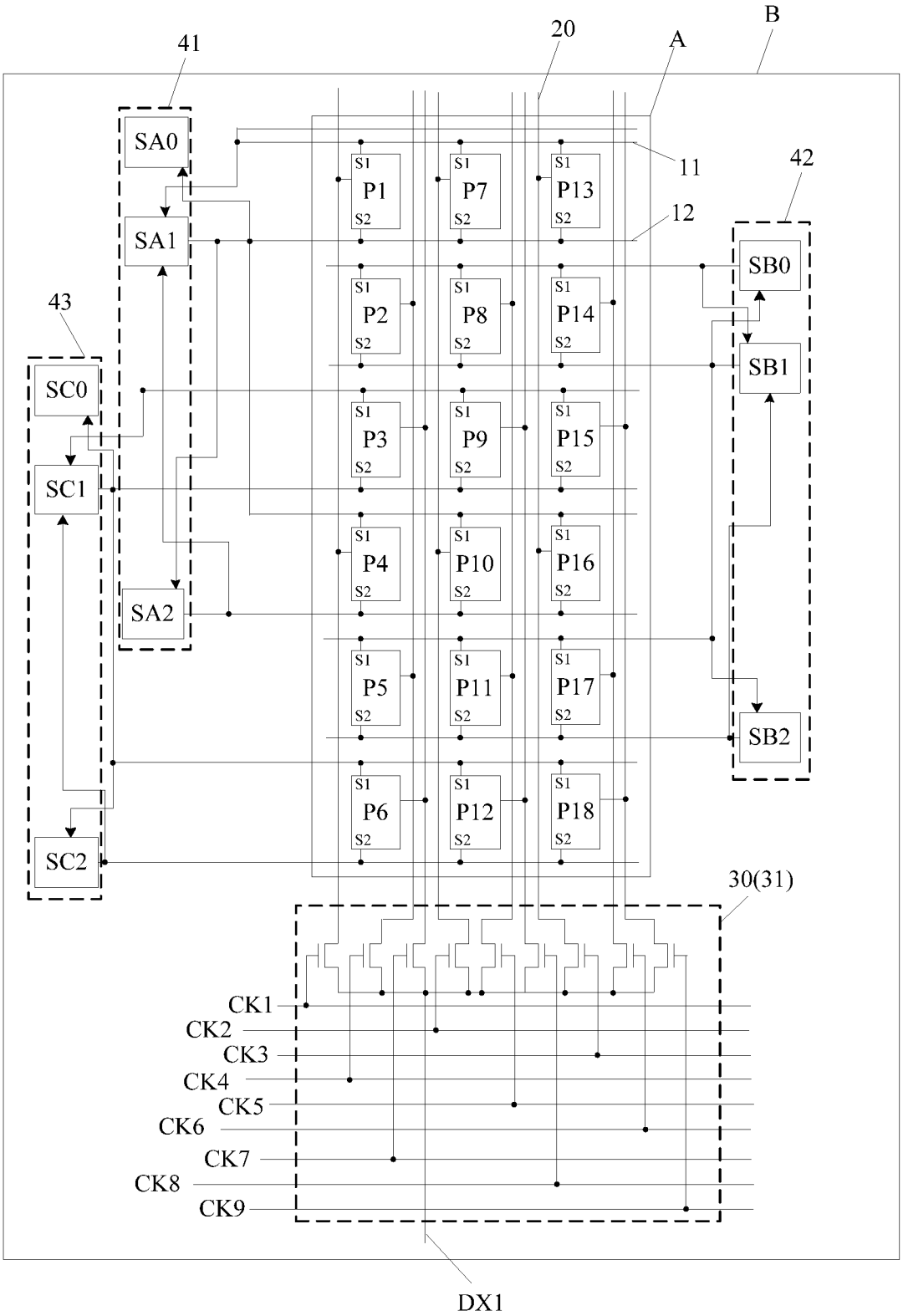
FIG. 4 illustrates another exemplary display panel consistent with various disclosed embodiments of the present disclosure.

FIG. 1 illustrates an exemplary display panel consistent with various disclosed embodiments of the present disclosure. FIG. 2 illustrates another exemplary display panel consistent with various disclosed embodiments of the present disclosure. FIG. 3 illustrates another exemplary display panel consistent with various disclosed embodiments of the present disclosure. FIG. 4 illustrates another exemplary display panel consistent with various disclosed embodiments of the present disclosure.

FIGS. 1-4 only exemplarily show the connection relationship between pixels, gate lines, data lines, shift registers, and multiplexers, and do not indicate the actual number of components. The actual number of pixels, gate lines, data lines, data lines, shift registers, and multiplexers may be determined according to the practical applications.

As shown in FIGS. 1-4, the display panel may include a display area A and a non-display area B. The non-display area B may surround the display area A.

The display panel may also include a plurality of pixels (such as P1 to P18) disposed in the display area A. Each pixel may include a pixel circuit (not shown). Each pixel circuit may include a first writing terminal (such as S1) for controlling the writing of an initialization signal, and a second writing terminal (such as S2) for controlling the writing of a data signal.

Further, the display panel may include a plurality of gate lines and a plurality of data lines. The plurality of gate lines may include a first gate line (such as 11) correspondingly connected to the first writing terminal S1 of the pixel circuit, and a second gate line (such as 12) correspondingly connected to the second writing terminal S2 of the pixel circuit. Each column of pixel circuits may be correspondingly connected to Q data lines (such as 20). Q may be an integer greater than 1. Any two adjacent pixel circuits in each column of pixel circuits may be correspondingly connected to different data lines 20. Each column of pixel circuits may be electrically connected to different data lines 20.

Further, the display panel may include a multiplexer 30 disposed in the non-display area B. The multiplexer 30 may include a plurality of selectors 31. The output terminal of each selector 31 may be electrically connected to a data line 20 correspondingly.

Further, the multiplexer 30 may include a plurality of control lines electrically connected to the selectors 31. The number of control lines (such as CK1 to CK9) may be the same as the number of output terminals of the selector 31. The control lines may be used to control one output terminal of the selector 31 to output to a data signal to a corresponding data line 20.

Further, the display panel may include a plurality of shift register groups (such as 41, 42 and 43) disposed in the non-display area B. Each shift register group may include a plurality of cascaded shift registers. Each shift register may be connected to at most two gate lines. N rows of pixels may be disposed between the pixels corresponding to two gate lines electrically connected to a same shift register. N may be a positive integer.

In one embodiment of the present disclosure, by disposing the plurality of shift register groups, the shift registers in each shift register group may respectively output a gate scan signal. Thus, the charging time of the gate scan signal may be increased. During the time for high frequency displaying, vertical streaks that occur due to the short charging time of the gate scan signal may be eliminated. Accordingly, the display performance may be improved.

Further, if the display panel is not provided with a multiplexer, the data lines may be connected to the driver IC through the corresponding data line leads. In such a configuration, data line leads with a same number of the data lines need to be provided in the lead area B1 shown in FIG. 1. Thus, the data line leads may need to occupy more areas. Further, because the area of the lead area B1 may be limited, the distance between the data line leads may be substantially small, a short circuit between the data line leads may easily occur. Accordingly, it may be difficult to achieve a high screen ratio and a narrow bezel design, and the display panel may have an abnormal display issue.

In one embodiment of the present disclosure, by disposing the multiplexer, the number of data line leads corresponding to the data lines may be reduced, and the distance between the data line leads may be increased to avoid the short-circuit issue and to ensure that the display panel may display normally. At the same time, because the number of data line leads may be reduced, and the area of the lead area B1 may be greatly reduced. Thus, it may facilitate to achieve a high screen ratio and narrow bezel design.

In one embodiment of the present disclosure, two ends of the gate line may be respectively provided with a shift register, i.e., a bilateral drive (not shown), to ensure the effective transmission of the gate scan signal, to reduce the voltage drop, and to improve the display uniformity.

In some embodiments, one end of the gate line may be provided with one shift register, i.e., an unilateral drive, as shown in FIGS. 1-4. Such a configuration may reduce the number of the shift register groups and reduce the non-display region occupied by the shift registers. Thus, the high screen ratio and narrow bezel design may be facilitated.

In one embodiment of the present disclosure, the number of the output terminals of the selector may be referred to as a first number, and the number of pixel columns electrically connected to each data line corresponding to any selector may be referred to as a second number. The first number may be Q times of the second number; and Q may be 2 or 3.

For example, as shown in FIG. 1 and FIG. 3, there are four output terminals in the selector 31, and each selector 31 may correspond to two columns of pixels. In such a configuration, Q is 2.

Another example may be referred to FIG. 2 and FIG. 4. As shown in FIG. 2, there are 6 output terminals in the selector 31, and each selector 31 corresponds to 2 columns of pixels. In such a configuration, Q is 3. Similarly, as shown in FIG. 4, there are 9 output terminals in the selector 31, and each selector unit 31 corresponds to 3 columns of pixels, and Q is still 3 in this configuration.

For such configurations, the selector 31 may be used to control the input of data signals to the corresponding data lines 20 with a time-sharing manner. The selector 31 may thus output the data signals in the time-sharing manner. For example, a first time and a second time may be involved in a time-sharing manner. In one embodiment, a multiplexer connection may include first and second control terminals, and first and second output terminals. In the first time, by turning on the first control terminal and turning off the second control terminal, the multiplexer may output a control signal to the first output terminal. In the second time, by turning off the first control terminal and turning on the second control terminal, the multiplexer may output a control signal to the second output terminal.

In one embodiment, under the control of the selector 31, the data signals in the data bus (such as DX1 or DX2) may be output to the corresponding data lines 20 with the time-sharing manner. Thus, the number of leads (not shown) of the data lines 20 in the non-display area B may be reduced while the data signals may be normally and effectively input to each pixel to ensure that each pixel may be normally and effectively driven. Accordingly, the display panel may display images normally.

In the present disclosure, the value of Q may not be limited to 2 or 3. It may also be other values, as long as the display panel may be able to display normally while it may facilitate to increase the charging time of the gate scan signal.

In some embodiments of the present disclosure, regardless of the value of Q, the shift register groups may be disposed as following.

In one embodiment of the present disclosure, the display panel may include a first shift register group and a second shift register group. The first shift register group may be correspondingly arranged with pixels in odd number rows through gate lines, and the second shift register group may be correspondingly arranged with pixels in even number rows through gate lines. Under such a configuration, N is 1 (i.e., there is one row of pixels between pixels corresponding two gate lines electrically connected to a same shift register).

For example, referring to FIG. 2, each shift register in the first shift register group 41 may be represented by SA, and each shift register in the second shift register group 42 may be represented by SB. Six rows of pixels are illustrated in FIG. 2. Each shift register in the first shift register group 41 may be arranged corresponding to the first row of pixels, the third row of pixels, and the fifth row of pixels through gate lines, and each shift register in the second shift register group 42 may be arranged corresponding to the second row of pixels, the fourth row of pixels, and the sixth row of pixels through gate lines.

Further, referring to FIG. 1 and FIG. 2, taking the shift register labeled as SA1 as an example, a gate line (e.g., 12) electrically connected to the second writing terminal S2 of the pixel P1 and a gate line electrically connected to a first writing terminal S1 of the pixel P3 may be both electrically connected to the shift register SA1. The pixel P1 and the pixel P3 may be spaced with one row of pixels. In particular, the pixel row where the pixel P2 is located may be disposed between the pixel P and the pixel P2, i.e., N is 1.

For such a configuration, the charging time of the gate scan signal may be increased. Thus, the vertical streaks that occur due to the short charging time of the gate scan signal may be eliminated while achieving a high-frequency display. Further, the structure complexity of the shift register may be reduced; and it may facilitate the manufacturing of the display panel.

In another embodiment of the present disclosure, the display panel may include a first shift register group, a second shift register group, and a third shift register group.

Three consecutive rows of pixels may be configured a first pixel group. The first shift register group may be configured to correspond to the first row of pixels in the first pixel group through gate lines. The second shift register group may be configured to correspond to the second row of pixels in the first pixel group through gate lines. The third shift register group may be configured to correspond to the third row of pixels in the first pixel group through gate lines.

The first row of pixels in the first pixel group may be the row of pixels farthest from the multiplexer in the first pixel group, and the third row of pixels may be the row of pixels nearest to the multiplexer in the first pixel group. For such a configuration, N is 2.

For example, referring to FIG. 3 and FIG. 4, each shift register in the first shift register group 41 may be represented by SA; each shift register in the second shift register group 42 may represented by SB; and each shift register in the third shift register group 43 may be represented by SC. Six rows of pixels are illustrated in FIG. 3 and FIG. 4. The first three rows of pixels may be configured a first pixel group. In the first pixel group, the first row of pixels may be the pixel row where the pixel P1 is located; the second row of pixels may be the pixel row where the pixel P2 is located; and the third row of pixels is the pixel row where the pixel P3 is located. Accordingly, the first shift register group 41 may be configured to correspond to the first row of pixels through the gate line; the second shift register group 42 may be configured to correspond to the second row of pixels through the gate line; and the third shift register group 43 may be configured to correspond to the third row of pixels through the gate line. In particular, each shift register group may be respectively configured to correspond to each row of pixels in the first pixel group.

Further, referring to FIG. 3 and FIG. 4, taking the shift register labeled SA1 as an example, a gate line electrically connected to the second writing terminal S2 of the pixel P1 and a gate line electrically connected to a first writing terminal S1 of the pixel P4 may all be electrically connected to the shift register SA1. The pixel P1 and the pixel P4 are spaced by two rows of pixels: the pixel row where the pixel P2 is located and the pixel row where the pixel P3 is located. In particular, N is 2.

In such a configuration, the charging time of the gate scan signal may be significantly increased. Thus, the vertical streaks that occur due to the short charging time of the gate scan signal may be effectively eliminated while a high-frequency display is realized. Accordingly, the display effect of the high-frequency product may be effectively improved.

In the present disclosure, the connection relationship between the shift registers in each shift register group may be as shown in FIG. 1 to FIG. 4. For each shift register group, except for the first level of shift register and the last level of shift register, the output terminal of each level of shift register may provide a valid pulse signal to the input terminal of a next level of shift register; and the output terminal of each level of shift register may provide a reset signal to the reset signal terminal of the previous level of shift register. The first level of shift register may a valid pulse signal to the input terminal of a next level of shift register; and the output terminal of the last level of shift register may provide a reset signal to a previous level of shift register.

In practical applications, for example, the connection relationship between the shift registers in each shift register group may also be other connection relationships known to those skilled in the art that can ensure the normal operation of the shift register.

Figure 5:
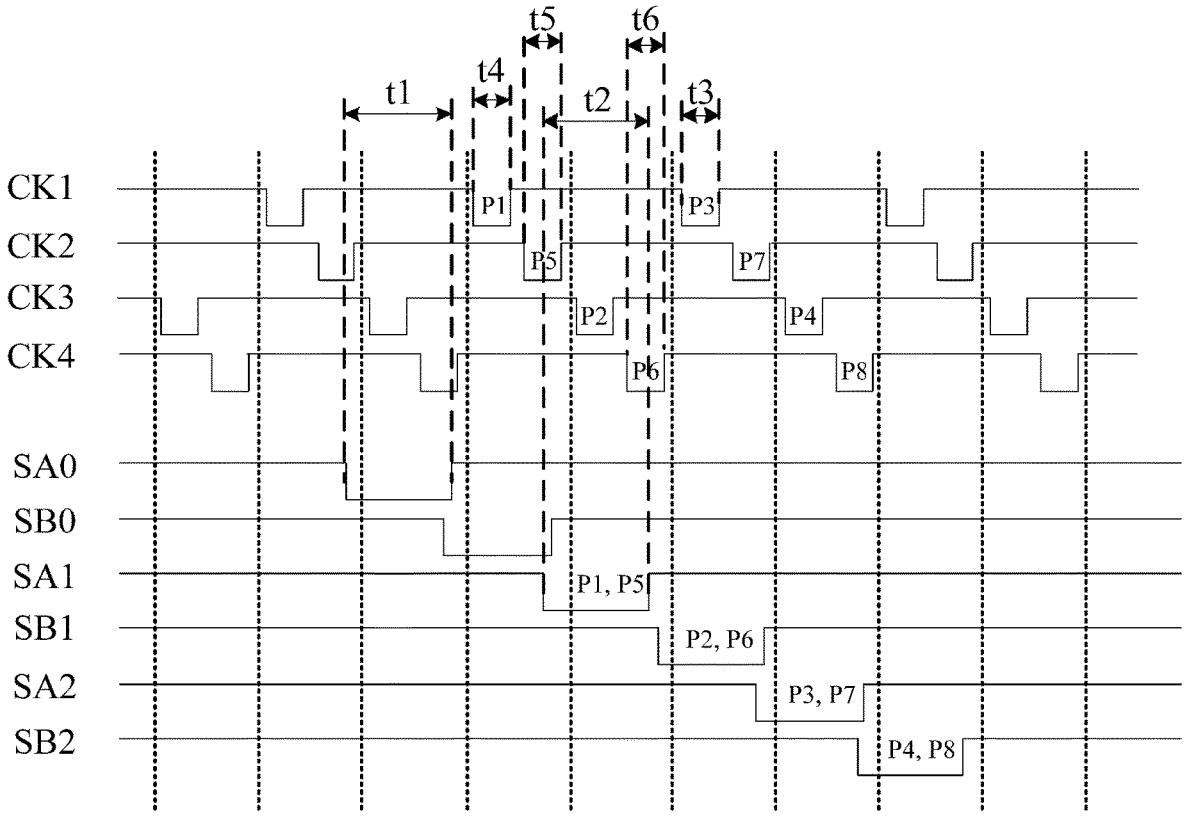
FIG. 5 illustrates an exemplary sequence diagram corresponding to the structure in FIG. 1 consistent with various disclosed embodiments of the present disclosure.
Figure 6:
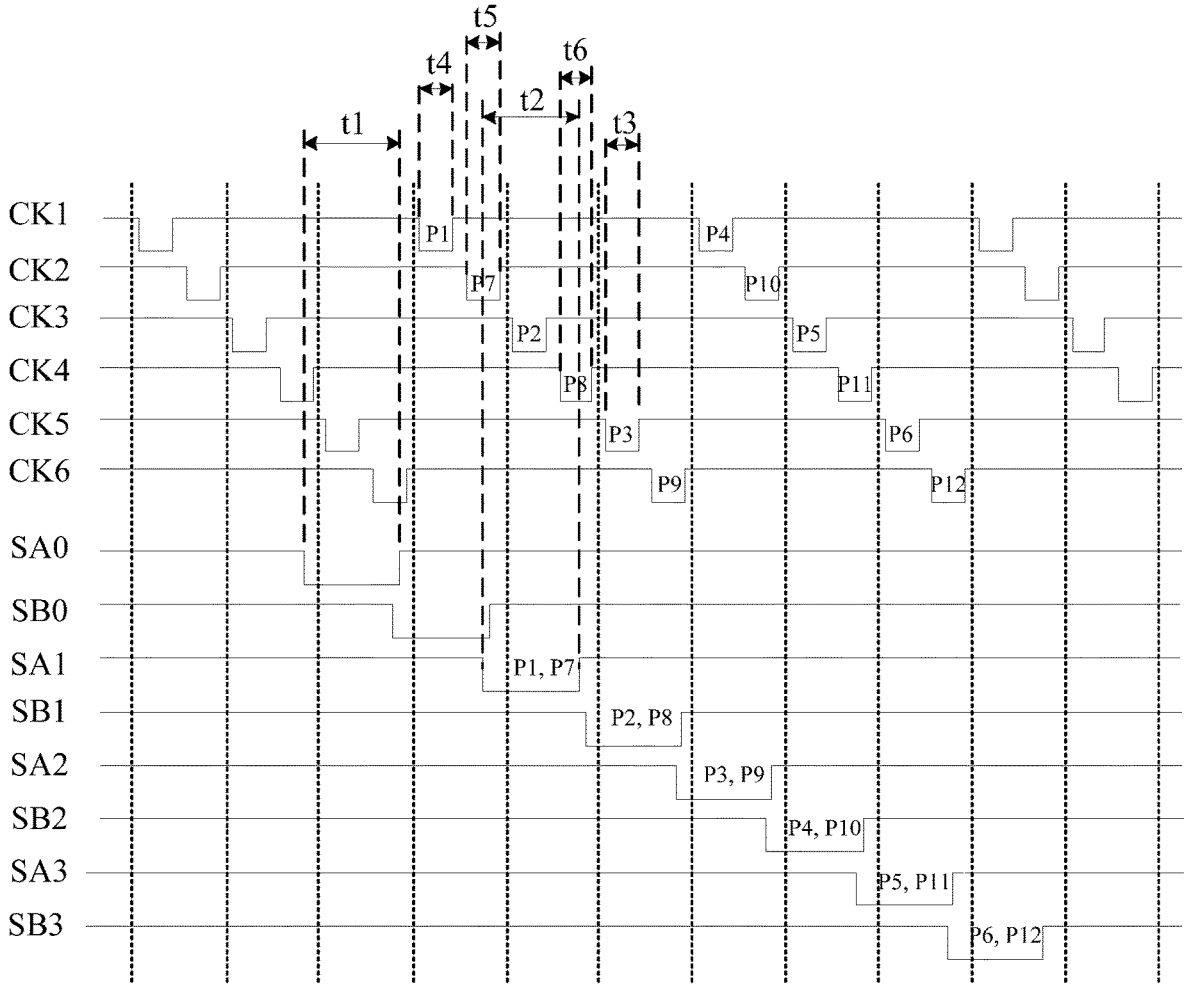
FIG. 6 illustrates an exemplary sequence diagram corresponding to the structure in FIG. 2 consistent with various disclosed embodiments of the present disclosure.
Figure 7:
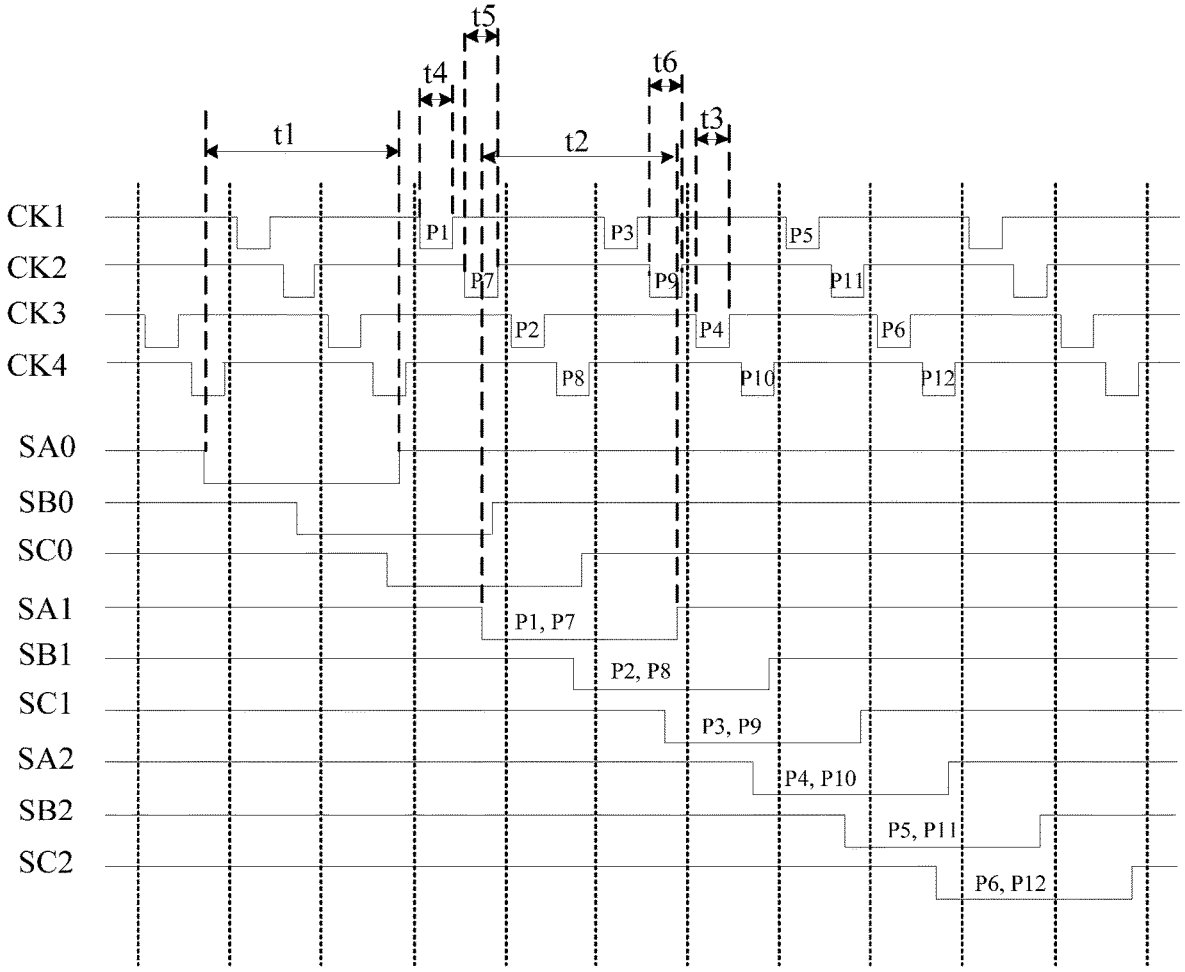
FIG. 7 illustrates an exemplary sequence diagram corresponding to the structure in FIG. 3 consistent with various disclosed embodiments of the present disclosure.
Figure 8:
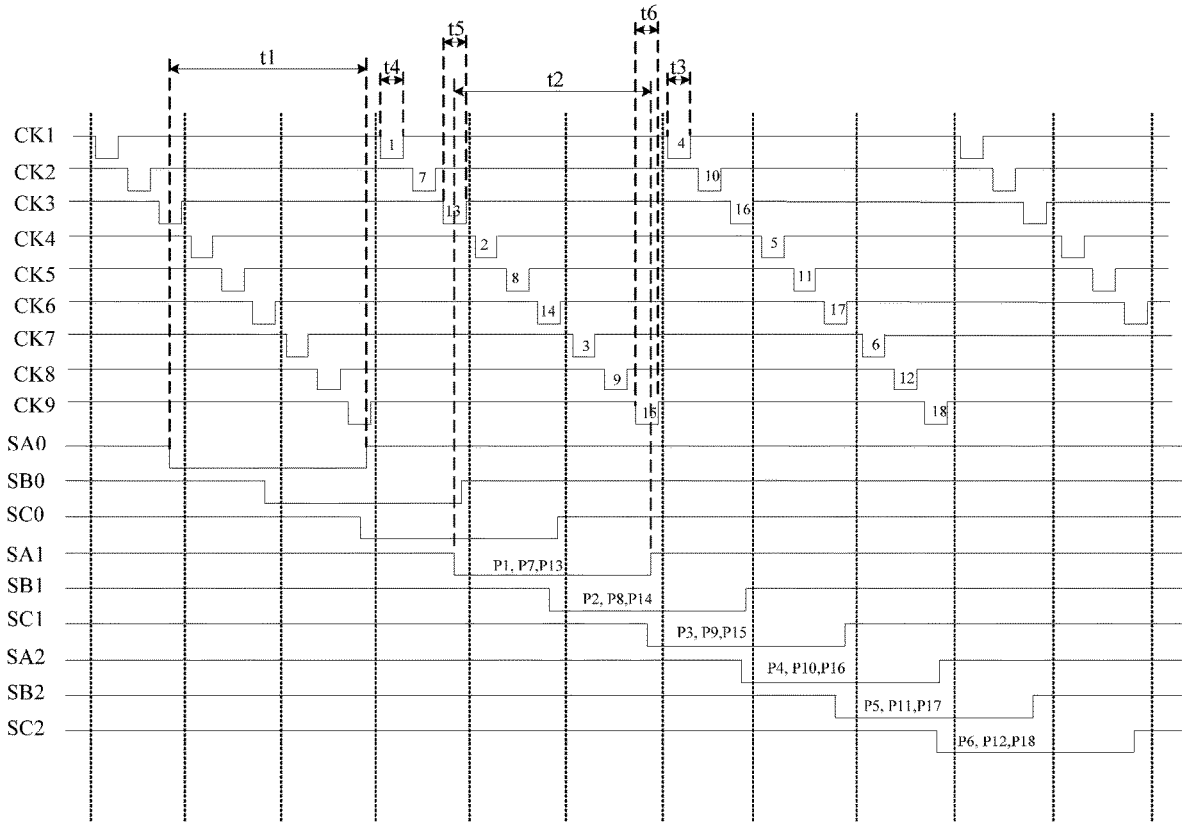
FIG. 8 illustrates an exemplary sequence diagram corresponding to the structure in FIG. 1 consistent with various disclosed embodiments of the present disclosure.
Figure 14:
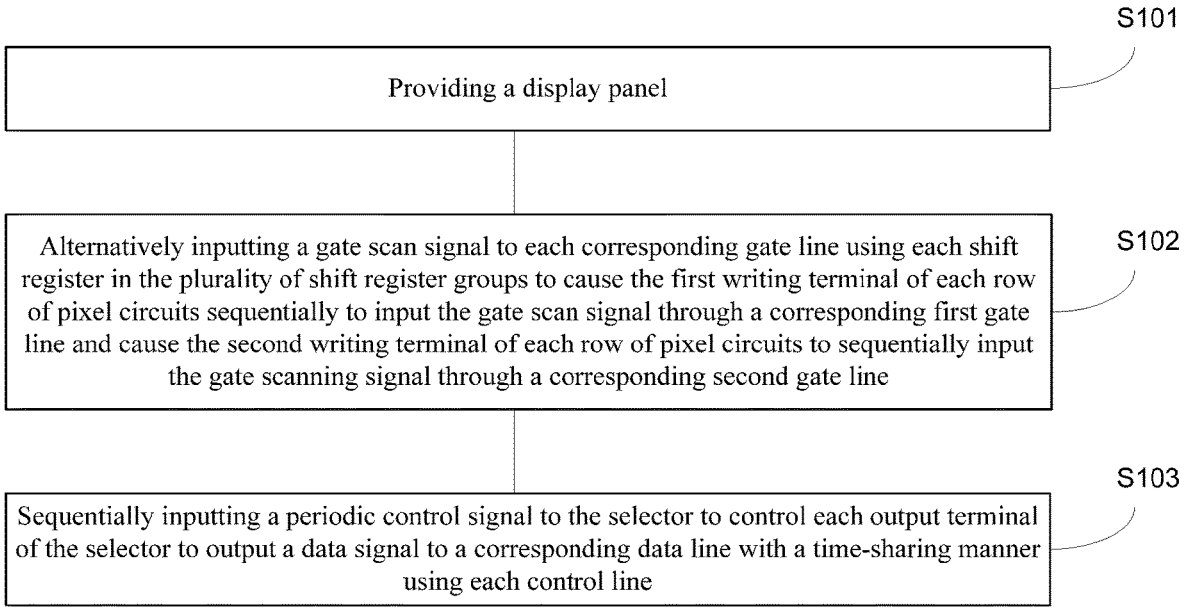
FIG. 14 illustrates an exemplary method for driving a display panel consistent with various disclosed embodiments.

The present disclosure also provides a method for driving a display panel. FIG. 14 illustrates an exemplary method for driving a display panel consistent with various disclosed embodiments of the present disclosure. FIG. 5 illustrates an exemplary sequence diagram corresponding to the structure shown in FIG. 1. FIG. 6 illustrates an exemplary sequence diagram corresponding to the structure shown in FIG. 2. FIG. 7 illustrates an exemplary sequence diagram corresponding to the structure shown in FIG. 3. FIG. 8 illustrates an exemplary sequence diagram corresponding to the structure shown in FIG. 4.

The display panel may be the previously described display panel. As shown in FIG. 14 and referring to FIG. 5 to FIG. 8, the driving method may include:

providing a display panel (S101);

alternatively inputting a gate scan signal to each correspondingly connected gate line using each shift register in the plurality of shift register groups to cause the first writing terminal of each row of pixel circuits sequentially to input the gate scan signal through the corresponding first gate line and cause the second writing terminal of each row of pixel circuits to sequentially input the gate scan signal through a corresponding second gate line (S102); and sequentially inputting a periodic control signal to the selector to control each output terminal of the selector to output a data signal to the corresponding data line with a time-sharing manner using each control line (S103).

The first gate line may input a gate scan signal before the second gate line. The pixels electrically connected to the data lines corresponding to a same selector may be the first pixels. The time period for inputting the gate scan signal to the first gate line corresponding to the i-th row of first pixels may be referred to as a first time period. The time period for inputting the gate scan signal to the second gate line corresponding to the i-th row of first pixels may be referred to as the second time period. The start time of the second time period may be later than the end time of the first time period.

The second gate line corresponding to in the i-th row of first pixels may be electrically connected to the first gate line corresponding to the (i+N+1)-th row of first pixels.

The elector may correspond to P column of first pixels. Each first pixel row may be electrically connected to P data lines. There are P control lines electrically connected to the P data lines. The control signal inputted earliest in each first pixel row corresponding to the P control lines may be a specified control signal.

The time period of the specified control signal corresponding to the (i+N+1)-th row of first pixels may be referred to as a third time period, and the end time of the second time period may be earlier than the start time of the third time period. i may be a positive integer, and P may be an integer greater than 1.

Taking the sequence diagram shown in FIG. 5, i as 1 and P is 2 as an example, correspondingly, the i-th row of first pixels may the first row of pixels, and the (i+N+1)-th row of pixels may be the third row of pixels. FIG. 5 illustrates a sequence diagram corresponding to the structure shown in FIG. 1. In FIG. 1, the first row may be the pixel row where the pixel P1 is located. The gate line electrically connected to the second writing terminal S2 of the pixel P1 may be the second gate line of the first row of first pixels. The third row may be the pixel row where the pixel P3 is located, and the gate line electrically connected to the first writing terminal S1 of the pixel P3 may be the first gate line of the third row of first pixels. Further, the second gate line corresponding to the first row of first pixels and the first gate line corresponding to the third row of first pixels may all be electrically connected to the shift register SA1. Moreover, in FIG. 1, the gate line electrically connected to the first writing terminal S1 of the pixel P1 may be the first gate line of the first row of first pixels, and the first gate line may be electrically connected to the shift register SA0.

Further, as shown in FIG. 5, the time period for the first gate line corresponding to the first row of first pixels to input the gate scan signal may be the time period for the shift register SA0 in FIG. 5 to output the gate scan signal. In particular, the time period may be the first time period (represented by t1). The time period for the second gate line corresponding to the first row of first pixels to input the gate scan signal may be the time period for the shift register SA1 in FIG. 5 to output the gate scan signal. In particular, the time period may be the second time period (represented by t2). The start time of the second time period t2 may be later than the end time of the first time period t1.

Moreover, in FIG. 1, each selector may correspond to two columns of first pixels, and each first pixel row may be electrically connected to two data lines, and there may be two control lines electrically connected to the two data lines. With reference to FIG. 1 and FIG. 5, the specified control signal corresponding to the third row of first pixels may be the signal marked as P3 among the periodic signals input by the control line CK1 in FIG. 5, and the time period of such an input signal may be a third time period t3. The end time of the second time period t2 may be earlier than the start time of the third time period t3. The reason may include followings.

On the one hand, the second time period t2 may be the time period for the second gate line corresponding to the first row of first pixels (i.e., the pixel row where the pixel P1 is located) to input the gate scan signal. During the second time period t2, the shift register SA1 may write a data signal to the second writing terminal S2 of the first row of first pixels.

On the other hand, the second time period t2 may also be the time period for the first gate line corresponding to the third row of first pixels (i.e., the pixel row where the pixel P3 is located) to input the gate scan signal. During the second time period t2, the shift register SA1 may write an initialization signal to the first writing terminal S1 of the third row of first pixels to complete the initialization of some nodes and structures in the pixel circuits.

To ensure the normal operation of the pixel circuits, the data signal may be written after the initialization is completed.

If the third time period t3 overlaps with the second time period t2, when the third row of first pixels (the pixel row where the pixel P3 is located) are not yet initialized, the control line Ckl may input a data signal to the data line corresponding to the pixel P3 through the selector. In particular, the data signal may be input during the initialization stage of the pixel circuit in the pixel P3. Such a condition may cause the pixel circuit to work disorderly, and then cause the pixel circuit to be unable to work normally. Accordingly, the display function of the display panel may be adversely affected.

Thus, in one embodiment of the present disclosure, because the end time of the second time period may be earlier than the start time of the third time period, it may be possible to prevent the second time period and the third time period from overlapping with each other. Accordingly, the issue that the data signal is input during the initialization stage of in the (i+N+1)-th row of first pixels caused by the overlapping between the second time period and the third time period may be avoided. In particular, the data signal may be input to the (i+N+1)-th row of first pixels after the initialization is completed so as to ensure that the display panel may function normally and effectively. Accordingly, the display apparatus may display normally and effectively.

In one embodiment, to ensure the normal operation of each pixel, as shown in FIG. 5 to FIG. 8, the time period of the specified control signal corresponding to the first pixel in the i-th row may be referred to as a fourth time period (such as t4). The start time of the fourth time period t4 may be later than the end time of the first time period t1.

Further, the start time of the second time period t2 may be later than the end time of the fourth time period t4. The reason may be as followings.

Taking the sequence diagram shown in FIG. 5 as an example, if the start time of the second time period t2 is earlier than the end time of the fourth time period t4, the second time period t2 and the fourth time period t4 may overlap with each other. Because the control line CK1 may output the control signal earlier than the control line CK2, during the second time period t2, the data line corresponding to control line CK1 may first input data. In particular, the data line corresponding to the control line CK1 may be charged first and may be charged until the end of the second time period t2. The data line corresponding to control line CK2 may input data later. In particular, the data line corresponding to the control line CK2 may be charged later and may be charged until the second time period t2 ends. Thus, during the second time period t2, the charging time of the data line corresponding to the control line CK1 may be longer than the charging time of the data line corresponding to the control line CK2. Under such a condition, the problem of uneven display may occur.

If the start time of the second time period t2 is later than the end time of the fourth time period t4, the above situation may not occur. Accordingly, the charging time of the data line corresponding to the control line CK1 and the charging time of the data line corresponding to the control line CK2 may be substantially the same. Thus, the problem of uneven display caused by different charging time may be avoided, and the display effect of the display panel may be improved.

Therefore, in one embodiment of the present disclosure, as shown in FIG. 5 to FIG. 8, the last control signal input in the P control lines corresponding to each row of first pixels may be referred to as the reference control signal. The time period of the reference control signal corresponding to the i-th row of first pixels may be referred to as a fifth time period (such as t5), and the start time of the second time period t2 may be within the fifth time period t5.

For such a configuration, the charging time of the data line corresponding to the control line CK1 and the charging time of the data line corresponding to the control line CK2 may be substantially close. Thus, the issue of uneven display caused by different charging time may be avoided; and the display performance of the display panel may be improved.

In one embodiment, as shown in FIG. 5 to FIG. 8, the time period of the reference control signal corresponding to the (i+N)-th row of first pixels may be referred to as a sixth time period (such as t6), and the end time of the second time period t2 may be within the sixth time period t6.

In some embodiments, in a practical application, the end time of the second time period t2 may be outside the sixth time period t6, but it is necessary to ensure that the end time of the second time t2 may be before the third time period t3 to ensure that the pixel circuit may work effectively. In particular, the end time of the second time period t2 may be set according to actual needs, as long as the charging time of the gate scan signal may be increased, and the display effect may be improved.

In one embodiment of the present disclosure, in a frame of image, at least portions of the first pixels in the first pixel row corresponding to the specified control signal may be located in a same column.

The sequence diagram shown in FIG. 5 and the first row of first pixels (including the pixel P1 and the pixel P5) may be used as an example. Because the start time of the second time period t2 may be within the fifth time period t5, the second time period t2 may overlap with the fifth time period t5. Accordingly, the start of the second time period t2 may not need to wait until the control lines corresponding to the first row of first pixels finish inputting control signals. In particular, before the control lines corresponding to in the first row of first pixels finish inputting the control signal, the second gate line corresponding to the first row of first pixels may have already started to input the gate scan signal. In particular, the second gate line corresponding to the first row of first pixels has started to charge; and the charging time may continue before the input time period (i.e., the third time period t3) of the specified control signal corresponding to the third row of first pixels.

Therefore, the charging time of the data lines corresponding to the first row of first pixels may overlap with the charging time of the data line corresponding to the second row of first pixels. In particular, using one group of data lines to write data signal in each first pixel in the first row and using another group of data lines to write data signals in each first pixel in the second row may increase the charging time of the gate scan signal on the basis of ensuring that each pixel may be driven normally and effectively. Accordingly, the display performance of the display panel may be enhanced.

In one embodiment, the setup of the specified control signal may have following approaches.

In one embodiment, in one frame of image, the first pixels corresponding to the specified control signals in all the first pixel rows may be located in a same column.

For example, referring to FIG. 1 and FIG. 5,

FIG. 1 illustrates four rows of first pixels. For the two columns of first pixels corresponding to the selector labeled as 31, the first row of first pixels may include a pixel P1 and a pixel P5. The first pixel corresponding to the specified control signal corresponding to the first row of first pixels may be the pixel P1. The second row of first pixels may include a pixel P2 and a pixel P6, and the first pixel corresponding to the specified control signal corresponding to the second row of first pixels may be the pixel P2. The third row of first pixels may include a pixel P3 and a pixel P7. The first pixel corresponding to the specified control signal corresponding to the third row of first pixel may be the pixel P3. The fourth row of first pixels may include a pixel P4 and a pixel P8. The first pixel corresponding to the specified control signal corresponding to the fourth row of first pixels may be the pixel P4. The pixel P1, the pixel P2, the pixel P3, and the pixel P4 may all be located in the same column.

For another example, referring to FIG. 2 and FIG. 6, FIG. 3 and FIG. 7, and FIG. 4 and FIG. 8, each of FIG. 2 to FIG. 4 illustrates six rows of first pixels. For each column of first pixels corresponding to the selector labeled as 31, the first pixel corresponding to the specified control signal corresponding to each row of first pixels may be a pixel P1, a pixel P2, a pixel P3, a pixel P4, a pixel P5, and a pixel P6. The pixel P1, the pixel P2, the pixel P3, the pixel P4, the pixel P5, and the pixel P6 may all be located in the same column.

By using such a configuration, the complexity for driving each frame of image may be significantly simplified, the calculation amount of the driver IC may be reduced, the requirements for the processing capability of the driver IC may be reduced; and the manufacturing cost of the driver IC may be reduced. Accordingly, the production cost of the display panel may also be reduced. Further, the probability of driving errors caused by a complicated driving process when the first pixels corresponding to specified control signals in different rows are located in different columns may be reduced. Thus, the driving accuracy of the display panel may be increased; and the display performance of the display panel may be enhanced.

Further, referring to FIG. 1 and FIG. 5 and taking the first row of first pixels including the pixel P1 and the pixel P5 as an example, when the start time of the second time period is within the fifth time period, regardless of whether the end time of the second time period is within the sixth time period, for the pixel P1 and the pixel P5 corresponding to the same selector, the following conditions may be obtained.

The time period (i.e., the fourth time period t4) of the control signal corresponding to the pixel P1 may not overlap with the time period (i.e., the second time t2) for the second gate line corresponding to the pixel P1 to input the gate scan signal. Under such a condition, the charging method of the pixel P1 may be referred to as a line charging method.

The time period (i.e., the fifth time period t5) of the control signal corresponding to the pixel P5 may overlap with the time period (i.e., the second time period t2) for the second gate line corresponding to the pixel P5 to input the gate scan signal. Under such a condition, the charging method of the pixel P5 may be referred to as a combination of a line charging method and a direct charging method.

In the practical applications, taking the selector corresponding to two columns of first pixels as an example, if the first pixels in one column are charged by a line charging method and the first pixels in the other column are charged by a combination of the line charging method and the direct charging method, the vertical streaks may occur.

Therefore, to solve the vertical streak issue, in one embodiment of the present disclosure, in one frame of image, when the first pixel corresponding to the specified control signal in each first pixel row is located in a same column, the following set up may be made.

In one frame of image, the order of inputting control signals to the control lines corresponding to the first pixels in different first pixel rows may be same.

In two consecutive frames of images, the first pixels corresponding to a specified control signal in the same first pixel row may be located in different columns.

Figure 9:
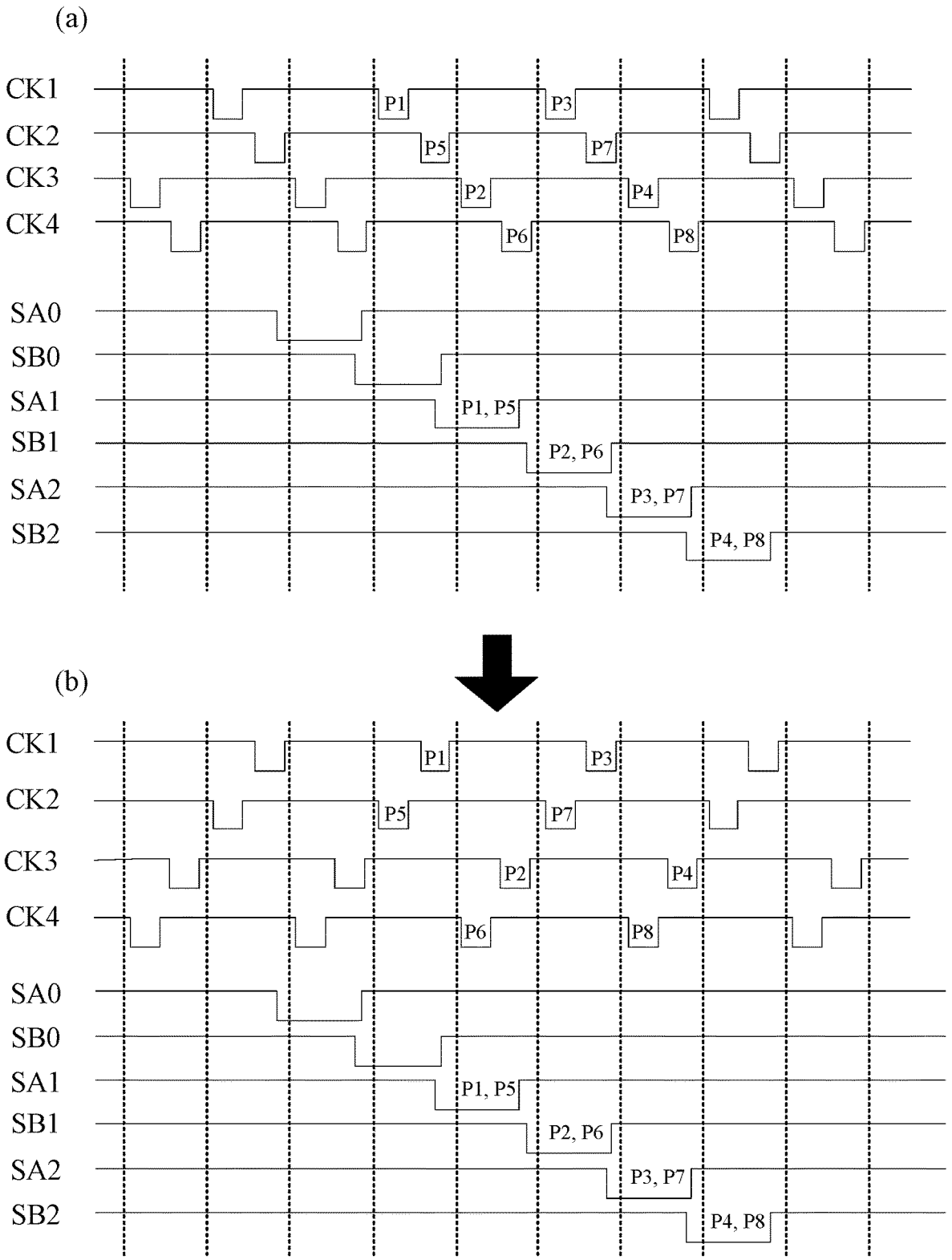
FIG. 9 illustrates an exemplary sequence diagram of two consecutive frames of images corresponding to the structure in FIG. 1 consistent with various disclosed embodiments of the present disclosure.

FIG. 9 illustrates an exemplary driving sequence diagram of two consecutive frames consistent with various disclosed embodiments of the present disclosure, and FIG. 9 is based on the sequence diagram shown in FIG. 5. FIG. 9 (*a*) represents the sequence diagram when the n-th frame of image is displayed; and FIG. 9 (*b*) shows the sequence diagram when the (n+1)-th frame of image is displayed.

In FIG. 9 (*a*), the pixel P1 and the pixel P5 may be located in the same row, and the control lines corresponding to these two pixels may be the control line CK1 and the control line CK2. The control line CK1 may input a control signal first then the control line CK2 may input the control signal. In particular, the control line corresponding to the pixel P1 may input the control signal, then the control line corresponding to the pixel P5 may input the control signal. Similarly, the pixel P2 and the pixel P6 may be located a same row, and the control line corresponding to the pixel P2 may input the control signal first, and then the control line corresponding to the pixel P6 may input the control signal. Further, the pixel P3 and the pixel P7 may be in a same row, and the control line corresponding to the pixel P3 may input the control signal first, and then the control line corresponding to the pixel P7 may input the control signal. The pixel P4 and the pixel P8 may be in a same row, and the control line corresponding to the pixel P4 may input the control signal first, then the control line corresponding to the pixel P8 may input the control signal.

Correspondingly, the order of inputting control signals to the control lines corresponding to the first pixels in each row in the FIG. 9 (*b*) may also be the same.

The first pixels in the first row may include the pixel P1 and the pixel P5, in the n-th frame of image, the first pixel corresponding to the specified control signal corresponding to the first row of first pixels may be the pixel P1. In the (n+1)-th frame of image, the first pixel corresponding to the specified control signal corresponding to the first row of first pixels may be the pixel P5. The pixel P1 and the pixel P5 may located a same row and in different columns.

In particular, in the n-th frame of image, the pixel P1, the pixel P2, the pixel P3, and the pixel P4 may be charged by the line charging method, and the pixel P5, the pixel P6, the pixel P7, and the pixel P8 may be charged by a combination of the line charging method and the direct charging method. In the (n+1)-th frame of images, the pixel P5, the pixel P6, the pixel P7, and the pixel P8 may all be charged by the line charging method, and the pixel P1, the pixel P2, the pixel P3, and the pixel P4 may all be charged by the combination of the line charging method and the direct charging method.

In such a configuration, by adjusting the input sequence of each control signal in two consecutive frames of images, in one frame of image, the first pixel corresponding to the specified control signal in each first pixel row may be located on the same column, the first pixel corresponding to a specified control signal in the same first pixel row in two consecutive frames of images may be prevented from being in a same column. Thus, the first pixels in the same column in two consecutive frames may be prevented from being charged by a same method. Accordingly, it may facilitate to eliminate vertical streaks caused by the charging method; and the display performance of the display panel may be improved.

In another embodiment, in one frame of picture, a portion of the first pixels corresponding to the specified control signal in the first pixel row may be in a same column.

Figure 10:
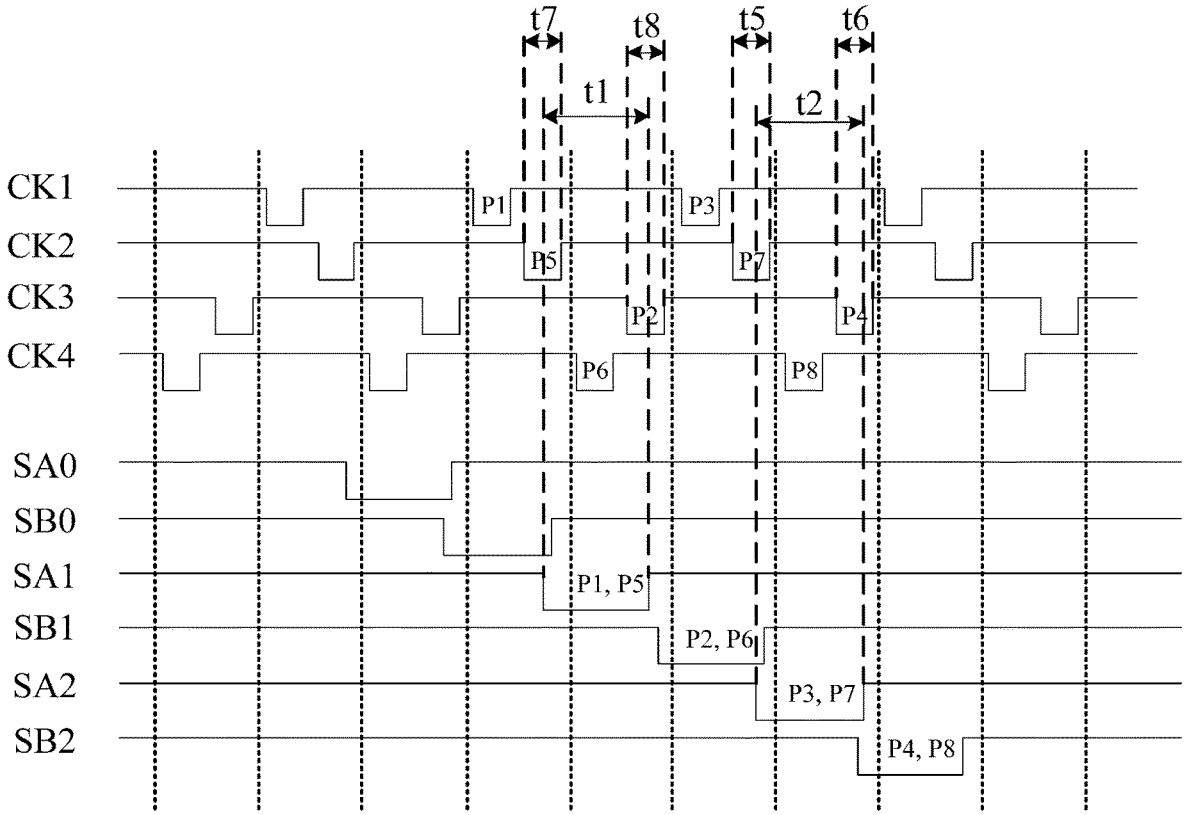
FIG. 10 illustrates another exemplary sequence diagram corresponding to the structure in FIG. 1 consistent with various disclosed embodiments of the present disclosure.

FIG. 10 illustrates another exemplary sequence diagram corresponding to the structure shown in FIG. 1 consistent with various disclosed embodiments of the present disclosure. The first row of first pixels may include a pixel P1 and a pixel P5. The first pixel corresponding to the specified control signal corresponding to the first row of first pixels may be the pixel P1. The second row of first pixels may include a pixel P2 and a pixel P6. The first pixel corresponding to the specified control signal corresponding to the second row of first pixels may be the pixel P6. The third row of first pixels may include a pixel P3 and a pixel P7. The first pixel corresponding to the specified control signal of corresponding to the third row of first pixels may be the pixel P3. The fourth row of first pixels may include a pixel P4 and a pixel P8. The first pixel corresponding to the specified control signal corresponding to the fourth row of first pixels may be the pixel P8. The pixel P1 and the pixel P3 may be located on the left column of the two columns of first pixels corresponding to the selector 31. The pixel P6 and the pixel P8 may be located on the right column of the two columns of first pixels corresponding to the selector 31.

In particular, in the left column of the two columns of first pixels corresponding to the selector 31, the pixel P1 and the pixel P3 may be charged by a line charging method; and the pixel P2 and the pixel P4 may be charged by a combination of a line charging method and a direct charging method. In the right column of the two columns of pixels corresponding to the selector 31, the pixel P6 and the pixel P8 may be charged by a line charging method, and the pixel P5 and the P7 may be charged by a combination of a line charging method and a direct charging method. In particular, each column of first pixels corresponding to the selector 31 may all include a first pixel charged by a line charging method and a first pixel charged by the combination of the line charging method and the direct charging method.

In such a configuration, by disposing a portion of the first pixels in the first pixel row corresponding to a specified control signal in a same column, the two charging methods of the line charging method and the combination of the line charging method and the direct charging method may be disrupted; and the spatial brightness of each pixel may be balanced. Thus, the issue of vertical streaks caused by the charging methods may be avoided; and the display effect of the display panel may be improved.

Figure 11:
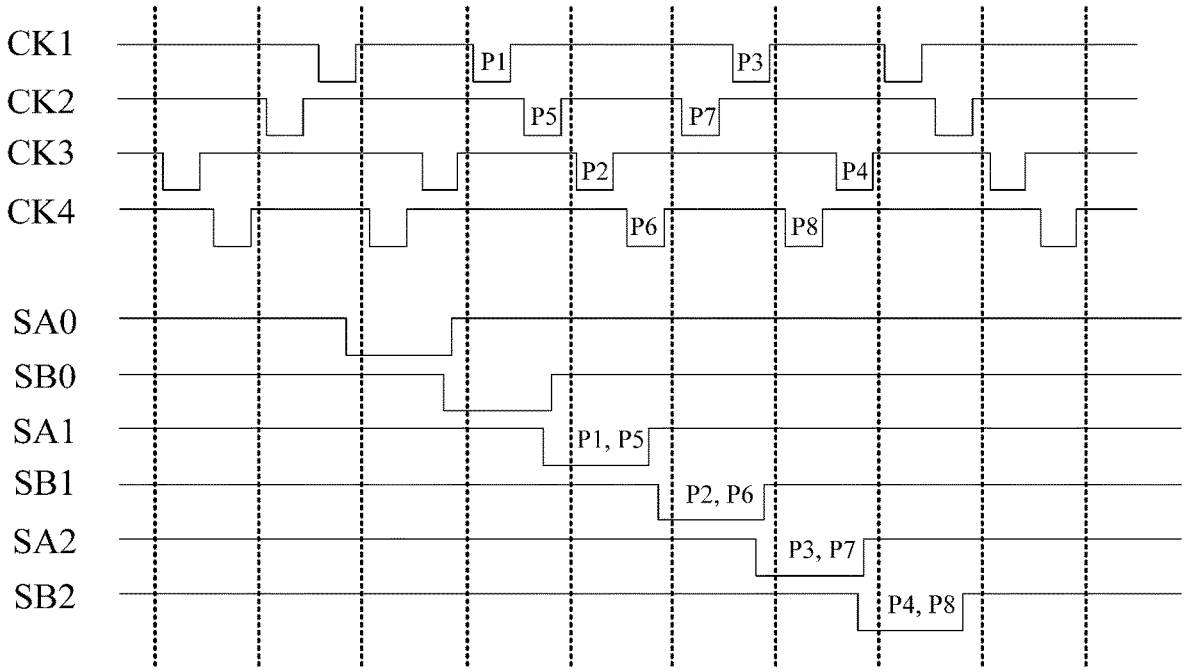
FIG. 11 illustrates another exemplary sequence diagram corresponding to the structure in FIG. 1 consistent with various disclosed embodiments of the present disclosure.

FIG. 11 illustrates another exemplary sequence diagram corresponding to the structure shown in FIG. 1. The first pixel corresponding to the specified control signal corresponding to the first row of pixels may be the pixel P1. The first pixel corresponding to the specified control signal corresponding to the second row of first pixels may be the pixel P2. The first pixel corresponding to the specified control signal corresponding to the third row of first pixels may be the pixel P7. The first pixel corresponding to the specified control signal corresponding to the fourth row of first pixels may be the pixel P8. The pixel P1 and the pixel P2 may be located on the left column of the two columns of first pixels corresponding to the selector 31. The pixel P7 and the pixel P8 may be located on the right column of the two columns of first pixels corresponding to the collector 31.

In particular, in the left column of the two columns of first pixels corresponding to the selector 31, the pixel P1 and the pixel P2 may be charged by a line charging method; and the pixel P3 and the pixel P4 may be charged by a combination of a line charging method and a direct charging method. In the right column of the two columns pixels corresponding to the selector 31, the pixel P7 and the pixel P8 may be charged by a line charging method, and the pixel P5 and the pixel P6 may be charged by a combination of a line charging method and a direct charging method. In particular, the first pixel in each column of first pixels corresponding to the selector 31 may include a first pixel charged by a line charging method and a first pixel charged by a combination of a line charging method and a direct charging method.

In such a configuration, in one frame of image, by disposing a portion of first pixels in the first pixel row corresponding to a specified control signal in a same column, the two charging methods of the line charging method and the combination of the line charging method and the direct charging method may be disrupted. Thus, the spatial brightness of each pixel may be balanced, and the issue of vertical streaks caused by the charging method may be avoided; and the display effect of the display panel may be improved.

Thus, in one embodiment of the present disclosure, in two consecutive frames of images, the first pixels corresponding to the specified control signal in the same first pixel row may be located in the same column.

In particular, in such a configuration, the sequence of the control signals of each frame of image may be same. That is, the driving sequence of each frame of image may be same. Thus, the complexity of the driving process may be reduced, the calculation amount of the driving IC may be reduced; and the power consumption of the display panel may be reduced.

In one embodiment of the present disclosure, the first pixels in adjacent K rows may be referred to as a second pixel group. K is a positive integer.

In one frame of image, the first pixels corresponding to the specified control signal corresponding to each first pixel row in the second pixel group may be located in a same column. The first pixels corresponding to the specified control signal corresponding to adjacent P second pixel groups may be located in different columns.

In such a configuration way, in one frame of image, a portion of the first pixels in the first pixel row corresponding to the specified control signal may be located in the same column. Thus, the two charging methods of the line charging method and the combination of the line charging method and the direct charging method may be disrupted. Accordingly, the spatial brightness of each pixel may be balanced, and the issue of vertical streaks caused by the charging methods may be avoided, and the display effect may be improved.

In one embodiment of the present disclosure, P is 2, and K is 1 or 2. In another embodiment, P is 3, and K is 1 or 2 or 3.

Taking the structure shown in FIG. 4 as an example, since P represents the number of columns of first pixels corresponding to a selector, and P is 3, when dividing the second pixel group, three adjacent rows of first pixels may be configured as the second pixel group. In particular, K is 3.

In some embodiments, for the structure shown in FIG. 4, two adjacent rows or one row may also be configured as a second pixel group. Accordingly, K is 2 or 1.

The values of P and K may be set according to actual needs to meet the needs of various application scenarios and improve the design flexibility; and as long as it may make two types of charging methods of the line charging method and the combination of the line charging method and the direct charging method to be disturbed and may spatially balance the brightness of each pixel to avoid the issue of vertical streaks.

In particular, to realize that in one frame of image, the first pixels in each first pixel row in the second pixel group corresponding to the specified control signal are disposed in a same column, and the first pixels in adjacent P second pixel groups corresponding to the specified control signal are respectively located in different columns, in the present disclosure, there may be several conditions:

In one embodiment, P is 2; K is 1; and each column of first pixels may correspond to two data lines.

The first pixels corresponding to the specified control signal corresponding to the odd number first pixel rows may be located in the first column, and the first pixels corresponding to the specified control signal corresponding to the even number first pixel rows may be located in the second column.

Referring to FIG. 1 and FIG. 10, K is 1, and P is 2. The second pixel group may include one row of first pixels. In particular, the first pixels corresponding to the specified control signal corresponding to the first row of pixel and the third row of pixels may be located in the first column, and the first pixels corresponding to the specified control signal corresponding to the second row of pixels and fourth row of pixels may be in the second column.

In such a configuration, the two charging methods of the line charging method and the combination of the line charging method and the direct charging method may be fully disrupted, and the spatial brightness of each pixel may be effectively balanced. Thus, the problem of vertical streaks may be effectively avoided, and the display effect may be effectively improved.

Correspondingly, in one embodiment of the present disclosure, when there are two shift register groups, as shown in FIG. 10, the input sequence of the gate scan signal may be as followings.

The start time of the second time period (such as t2) may be within the time period (such as t5) of the reference control signal corresponding to the i-th row of first pixels (such as the pixel row in which pixel P3 and pixel P7 are located in FIG. 10). The end time of the second time period t2 may be within the time period (such as t6) of the reference control signal corresponding to the (i+1)-th row of pixels (such as the pixel row in which pixel P4 and the pixel P8 are located in FIG. 10).

The start time of the first time period (such as t1) may be within the time period (such as t7) of the reference control signal corresponding to the (i−2)-th row of pixels (such as the pixel row where the pixel P1 and the pixel P5 are located in FIG. 10). The end time of the first time period t1 may be located within the time period (such as t8) of the reference control signal corresponding to the (i−1)-th row of first pixels (such as the pixel row where pixel 2 and the pixel P6 are located in FIG. 10).

In such a configuration, it may be possible to ensure that the pixel circuit in each pixel may work normally and effectively; and ensure that each pixel may be driven normally and effectively. Thus, on the basis of increasing the charging time of the gate scan signal, it may ensure that the display panel may normally display an image.

In another embodiment of the present disclosure, P may be 3; and K may be 3. Each column of first pixels may correspond to three data lines.

For three adjacent second pixel groups, the first pixels corresponding to the specified control signal corresponding to each first pixel row of the first second pixel group may all be located in the first column. The first pixels corresponding to the specified control signal corresponding to each first pixel row of the second second pixel group may all be located in the second column. The first pixels corresponding to the specified control signal corresponding to each first pixel row in the third second pixel group may all be located in the third column.

Figure 12:
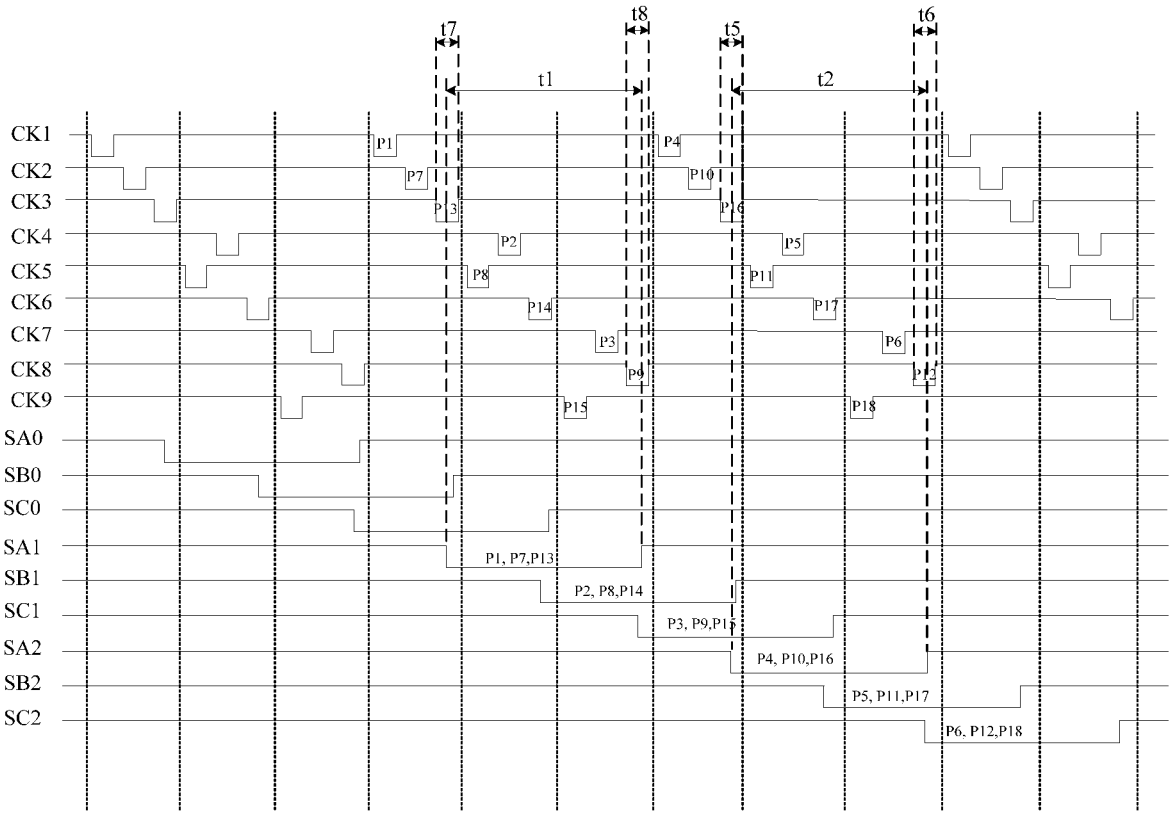
FIG. 12 illustrates another exemplary sequence diagram corresponding to the structure in FIG. 4 consistent with various disclosed embodiments of the present disclosure.

FIG. 12 illustrates another exemplary sequence diagram corresponding to the structure shown in FIG. 4. Referring to FIG. 4 and FIG. 12, K may be 1, P may be 2; and the second pixel group may include one row of first pixels. Taking the three rows of first pixels where the pixel P1, the pixel P2 and the pixel P3 are respectively located as three adjacent second pixel groups as an example, the first pixel corresponding to a specified control signal corresponding to the first second pixel group may be located in the first column (i.e., the column where the pixel P1 is located). The first pixel corresponding to the specified control signal corresponding to the second pixel group may be located in the second column (i.e., the column where the pixel P8 is located). The first pixel corresponding to the specified control signal corresponding to the third second pixel group may be located in the third column (i.e., the column where pixel P15 is located).

In such a configuration, the two charging methods of the line charging method and the combination of the line charging method and the direct charging method may be fully disrupted, and the spatial brightness of each pixel may be effectively balanced. Thus, the issue of vertical streaks may be effectively avoided, and the display effect may be effectively improved.

Correspondingly, as shown in FIG. 12, in one embodiment of the present disclosure, when the display panel includes three shift register groups, the input sequence of the gate scan signal may be as following.

The start time of the second time period (such as t2) may be located within the time period (such as t5) of the reference control signal corresponding to the i-th row (such as the pixel row where the pixel P4, the pixel P10, and the pixel P16 are located in FIG. 12) of first pixels. The end time of the second time period t2 may be within the time period (such as t6) of the reference control signal corresponding to the (i+2)-th row (such as the pixel row where the pixel P6, the pixel P12, and the pixel P18 are located in FIG. 12) of first pixels.

The starting time of the first time period (such as t1) may be within the time period (such as t7) of the reference control signal corresponding to the (i−3)-th row (such as the pixel row where which pixel P1, pixel P7, and pixel P13 are located in FIG. 12) of first pixels. The end time of the first time period t1 may be within the time period (such as t8) of the reference control signal corresponding to the (i−1)-th row (such as the pixel row where the pixel P3, the pixel P9, and the pixel P15 are located in FIG. 12) of first pixels.

In such a configuration, it may be possible to ensure that the pixel circuit in each pixel may work normally and effectively; and ensure that each pixel may be driven normally and effectively. Thus, on the basis of increasing the charging time of the gate scan signal, it may ensure that the display panel may normally display an image.

It should be noted that, in one embodiment of the present disclosure, the first-level shift register in each shift register group may electrically connected to a start signal line, as shown in FIG. 1, such that the start signal line may provide the start signal to the input terminal of the first level shift register to ensure that the shift register of each level may work normally and effectively. At the same time, the setting method and setting sequence of the start signal line may be any setting method and setting sequence that are known to those skilled in the art to achieve the normal operation of each shift register group.

Figure 13:
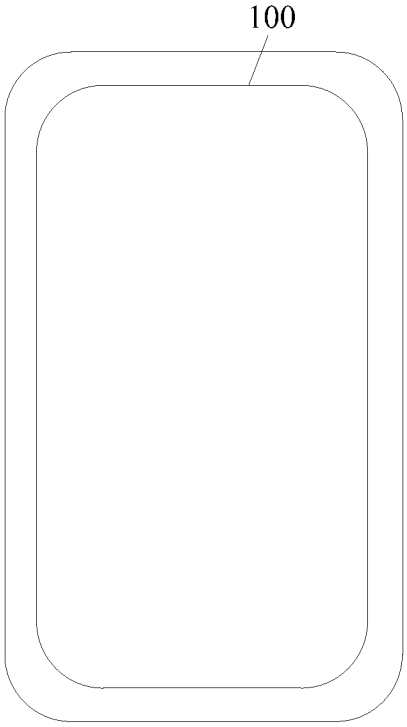
FIG. 13 illustrates an exemplary display apparatus consistent with various disclosed embodiments of the present disclosure.

The present disclosure also provides a display apparatus. FIG. 13 illustrates an exemplary display apparatus consistent with various disclosed embodiments of the present disclosure.

As shown in FIG. 13, the display apparatus may include a display panel 100. The display panel 100 may be a disclosed display panel, or other appropriate display panel.

The display panel 100 may be an electroluminescence display panel. Each pixel in the display panel may include not only a pixel circuit but also a light-emitting unit electrically connected to the pixel. The light-emitting unit may include an anode, a light-emitting layer, and a cathode. The anode and the pixel circuit may be electrically connected. The negative and positive charges may be input to the light-emitting layer through the cathode and the anode, respectively. The negative and positive charges may recombine in the light-emitting layer to generate energy, and the energy may excite the light-emitting material in the light-emitting layer to emit light. Accordingly, the display function may be achieved.

In the practical applications, the display apparatus may be any products or components having a display function, such as a mobile phone (as shown in FIG. 13), a tablet computer, a television, a display, a notebook computer, a digital photo frame, or a navigation device, etc. For the implementation of the display apparatus, reference may be made to the embodiments of the display panel described above.

Thus, the display panel, the method for driving the display panel and the display panel provided by the present disclosure may have following beneficial effects.

Firstly, by setting a multiplexer, the area of the non-display area occupied by the corresponding leads of the data lines may be reduced. Thus, the non-display area may be set narrower, and a design with a high screen ratio and a narrow bezel may be realized.

Secondly, by setting a plurality of shift register groups, the shift registers in each shift register group may output the gate scan signals, respectively. Thus, the charging time of the gate scan signal may be increased while achieving a high-frequency display. Accordingly, the vertical streaks that occur due to the short charging time of the gate scan signal may be eliminated; and the display performance may be improved.

Thirdly, because the end time of the second time period may be earlier than the start time of the third time period, it is possible to avoid the overlap between the second time period and the third time period. Accordingly, the input of the data signal during the initialization phase of the (i+N+1)-th row of first pixels caused by the overlapping between the second time period and the third time period. In particular, the data signal may be input after the initialization of the (i+N+1)-th row to of first pixels to ensure that the display panel may be be driven normally and effectively. Accordingly, the display apparatus may be ensured to. display normally and effectively.

The description of the disclosed embodiments is provided to illustrate the present disclosure to those skilled in the art. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A display panel, comprising:

a display area;

a non-display area surrounding the display area;

a plurality of pixels in the display area, wherein each pixel includes a pixel circuit, the pixel circuit includes a first writing terminal configured to control writing of an initialization signal and a second writing terminal configured to control writing of a data signal;

a plurality of gate lines and a plurality of data lines, wherein the gate lines include a first gate line electrically connected to the first writing terminal of the pixel circuit and a second gate line electrically connected to the second writing terminal of the pixel circuit, each column of pixel circuits correspond to Q data lines, Q is an integer greater than one, any two adjacent pixel circuits of each column of pixel circuits are correspondingly connected to different data lines, and each column of pixel circuits are electrically connected to different data lines;

a demultiplexer in the non-display area, wherein the demultiplexer includes a plurality of selectors, and an output terminal of each selector is electrically connected to a corresponding data line;

a plurality of control lines electrically connected to the plurality of selectors, wherein a number of the control lines is equal to a number of output terminals of the plurality of selectors and each of the plurality of control lines is used to control an output terminal of a corresponding one of the selectors to output a data signal to a corresponding one of the data lines; and a plurality of shift register groups in the non-display area, wherein each shift register group includes a plurality of cascaded shift registers and each shift register is electrically connected to at most two of the plurality of gate lines, there are N rows of pixels between pixels corresponding to two of the plurality of gate lines electrically connected to a same shift register, and N is a positive integer.

2. The display panel according to claim 1, wherein:

the number of the output terminals of the plurality of selectors is a first number;

a number of pixel columns electrically connected to each data line corresponding to any of the plurality of selectors is a second number;

the first number is Q times of the second number; and

Q is two or three.

3. The display panel according to claim 2, further comprising:

a first shift register group disposed corresponding to odd number rows of pixels through gate lines; and a second shift register group disposed corresponding to even number rows of pixels through gate lines, wherein N is one.

4. The display panel according to claim 2, further comprising:

a first shift register group;

a second shift register group; and a third shift register group, wherein:

three adjacent rows of pixels are configured as a first pixel group, the first shift register group is disposed corresponding to a first row of pixels of the first pixel group through gate lines;

the second shift register group is disposed corresponding to a second row of pixels of the first pixel group through gate lines;

the third shift register group is disposed corresponding to a third row of pixels of the first pixel group through gate lines;

the first row of pixels of the first pixel group is a row of pixels of the first pixel group furthest away from the demultiplexer;

the third row of pixels of the first pixel group is a row of pixel of the first pixel group nearest to the demultiplexer; and N is two.

5. A method for driving a display panel, comprising:

providing a display panel, wherein the display panel includes:

a display area;

a non-display area surrounding the display area;

a plurality of pixels in the display area, wherein each pixel includes a pixel circuit, the pixel circuit includes a first writing terminal configured to control a writing of an initialization signal and a second writing terminal configured to control a writing of a data signal;

a plurality of gate lines and a plurality of data lines, wherein the gate lines include a first gate line electrically connected to the first writing terminal of the pixel circuit and a second gate line electrically connected to the second writing terminal of the pixel circuit, each column of pixels correspond to Q data lines, Q is an integer greater than one, any two adjacent pixel circuits of each column of pixel circuits are correspondingly connected to different data lines, and each column of pixel circuits are electrically connected to different date lines;

a demultiplexer in the non-display area, wherein the demultiplexer includes a plurality of selectors, and an output terminal of each selector is electrically connected to a corresponding data line;

a plurality of control lines electrically connected to the plurality of selectors, wherein a number of the control lines is equal to a number of output terminals of the plurality of selectors and each of the plurality of control lines is used to control an output terminal of a corresponding one of the selectors to output a data signal to a corresponding one of the data lines; and a plurality of shift register groups in the non-display area, wherein each shift register group includes a plurality of cascaded shift registers and each shift register is electrically connected to at most two of the plurality of gate lines, there are N rows of pixels between pixels corresponding to two of the plurality of gate lines electrically connected to a same shift register and N is a positive integer;

alternatively inputting a gate scan signal to each corresponding gate line using each shift register in the plurality of shift register groups to cause the first writing terminal of each row of pixel circuits sequentially to input the gate scan signal through a corresponding first gate line and cause the second writing terminal of each row of pixel circuits to sequentially input the gate scan signal through a corresponding second gate line; and sequentially inputting a periodic control signal to the corresponding one selector to control each output terminal of the corresponding one selector to output a data signal to a corresponding data line with a time-sharing manner using each control line, wherein:

the first gate line inputs the gate scan signal before the second gate line;

the pixels electrically connected to the data lines corresponding to a same selector are first pixels;

a time period for inputting the gate scan signal to the first gate line corresponding to an i-th row of first pixels is a first time period;

a time period for inputting the gate scan signal to the second gate line corresponding to the i-th row of first pixels is a second time period;

a start time of the second time period is later than an end time of the first time period;

the second gate line corresponding to the i-th row of first pixels is electrically connected to the first gate line corresponding to the (i+N+1)-th row of first pixels;

the corresponding one selector corresponds to P columns of first pixels;

each first pixel row is electrically connected to P data lines;

there are P control lines electrically connected to the P data lines;

a control signal inputted earliest in the P control lines corresponding to each first pixel row is a specified control signal;

a time period of the specified control signal corresponding to the (i+N+1)-th row of pixels is a third time period;

an end time of the second time period is earlier than a start time of the third time period;

i is a positive integer; and

P is an integer greater than 1.

6. The method according to claim 5, wherein:

a time period of the specified control signal corresponding to the first pixel of the i-th row is a fourth time period;

a start time of the fourth time period is later than the end time of the first time period; and the start time of the second timer period is later than an end time of the fourth time period.

7. The method according to claim 6, wherein:

a control signal inputted latest by the P control lines corresponding to each row of first pixels is a reference control signal;

a time period of the reference control signal corresponding to the i-th row of first pixels is a fifth time period; and the start time of the second time period is within the fifth time period.

8. The method according to claim 7, wherein:

a time period of the reference control signal corresponding to an (i+N)-th row of first pixels is a sixth time period; and the end time of the second time period is within the sixth time period.

9. The method according to claim 7, wherein:

in one frame of image, at least of a portion of first pixels in the first pixel row corresponding to the specified control signal are located in a same column.

10. The method according to claim 9, wherein:

in one frame of image, first pixels in each first pixel row corresponding to the specified control signal are located in a same column;

in one frame of image, orders of control signals input by control lines corresponding to each first pixel in different first pixel rows are same; and in two consecutive frame of images, first pixels corresponding to the specified control signal corresponding to a same first pixel row are located in different columns.

11. The method according to claim 9, wherein:

in one frame of image, a portion of first pixels in the first pixel row corresponding to the specified control signal are located in a same column; and in two consecutive frames of images, first pixels corresponding to the specified control signal corresponding to a same first pixel row are located in a same column.

12. The method according to claim 11, wherein:

adjacent K rows of first pixels are configured as a second pixel group;

K is a positive integer;

in one frame of image, first pixels corresponding to the specified control signal corresponding to each first pixel row in the second pixel group are located in a same column; and first pixels corresponding to the specified control signal corresponding to adjacent P second pixel groups are located in different columns.

13. The method according to claim 12, wherein:

P is two, and K is one or two; or

P is three, and K is one or two or three.

14. The method according to claim 12, wherein:

P is two, and K is one;

each column of first pixels correspond to two data lines;

first pixels corresponding to the specified control signal corresponding to odd number first pixel rows are located in a first column; and first pixels corresponding to the specified control signal corresponding to even number first pixel rows are located in a second column.

15. The method according to claim 14, wherein:

the display panel includes two shift register groups;

the start time of the second time period is within a time period of the control reference signal corresponding to the i-th row of first pixels;

the end time of the second time period is within a time period of the control reference signal corresponding to the (i+1)-th row of first pixels;

the start time of the first time period is within a time period of the control reference signal corresponding to the (i−2)-th row of first pixels; and the end time of the first time period is within a time period of the control reference signal corresponding to the (i−1)-th row of first pixels.

16. The method according to claim 12, wherein:

P is two, and K is three;

each row of first pixels correspond to three data lines;

for three adjacent second pixel groups, first pixels corresponding to the specified control signal corresponding to each first pixel row in a first second pixel group are all in a first column;

first pixels corresponding to the specified control signal corresponding to each first pixel row in a second second pixel group are all in a second column; and first pixels corresponding to the specified control signal corresponding to each first pixel row in a third second pixel group are all in a third column.

17. The method according to claim 16, wherein:

the display panel includes three shift register groups;

the start time of the second time period is within a time period of the control reference signal corresponding to the i-th row of first pixels;

the end time of the second time period is within a time period of the control reference signal corresponding to the (i+2)-th row of first pixels;

the start time of the first time period is within a time period of the control reference signal corresponding to the (i−3)-th row of first pixels; and the end time of the first time period is within a time period of the control reference signal corresponding to the (i−1)-th row of first pixels.

18. A display apparatus, comprising:

a display panel, wherein the display panel includes:

a display area;

a non-display area surrounding the display area;

a plurality of pixels in the display area, wherein each pixel includes a pixel circuit, the pixel circuit includes a first writing terminal configured to control a writing of an initialization signal and a second writing terminal configured to control a writing of a data signal;

a plurality of gate lines and a plurality of data lines, wherein the gate lines include a first gate line electrically connected to the first writing terminal of the pixel circuit and a second gate line electrically connected to the second writing terminal of the pixel circuit, each column of pixels correspond to Q data lines, Q is an integer greater than one, any two adjacent pixel circuits of each column of pixel circuits correspond to different data lines, and each column of pixel circuits may are electrically connected to different data lines;

a demultiplexer in the non-display area, wherein the demultiplexer includes a plurality of selectors, and an output terminal of each selector is electrically connected to a corresponding data line;

a plurality of control lines electrically connected to the plurality of selectors, wherein a number of the control lines is equal to a number of output terminals of the plurality of selectors and each of the plurality of control lines is used to control an output terminal of a corresponding one of the selectors to output a data signal to a corresponding one of the data lines; and a plurality of shift register groups in the non-display area, wherein each shift register group includes a plurality of cascaded shift registers and each shift register is electrically connected to at most two of the plurality of gate lines, there are N rows of pixels between pixels corresponding to two of the plurality of gate lines electrically connected to a same shift register and N is a positive integer.

19. The display panel according to claim 18, wherein:

the number of the output terminals of the plurality of selectors is a first number;

a number of pixel columns electrically connected to each data line corresponding to any of the plurality of selectors is a second number;

the first number is Q times of the second number; and

Q is two or three.

20. The display panel according to claim 19, further comprising:

a first shift register group disposed corresponding to odd number rows of pixels through gate lines; and a second shift register group disposed corresponding to even number row of pixels through gate lines, wherein N is one.

* * * * *